US009518376B1

(12) United States Patent
Shirchenko et al.

(10) Patent No.: US 9,518,376 B1
(45) Date of Patent: Dec. 13, 2016

(54) POSITION REPORTING FOR ROAD TREATMENT ELEMENTS

(71) Applicant: DiCAN Inc., Catharines (CA)

(72) Inventors: Michael Shirchenko, St. Catharines (CA); Ken Stapleton, St. Catharines (CA); Alexander Steven Ross, Hamilton (CA)

(73) Assignee: DiCAN Inc., St. Catharines (CA)

( * ) Notice: Subject to any disclaimer, the term of this patent is extended or adjusted under 35 U.S.C. 154(b) by 0 days.

(21) Appl. No.: 14/859,168

(22) Filed: Sep. 18, 2015

(51) Int. Cl.

| | |
|---|---|
| ***E02F 9/20*** | (2006.01) |
| ***E01H 5/00*** | (2006.01) |
| ***E01H 5/06*** | (2006.01) |
| ***E02F 9/22*** | (2006.01) |

(52) U.S. Cl.
CPC ..... *E02F 9/2029* (2013.01); *E01H 5/00* (2013.01); *E01H 5/061* (2013.01); *E01H 5/065* (2013.01); *E02F 9/22* (2013.01)

(58) Field of Classification Search
CPC ..... E02F 9/20; E02F 9/22; E01H 5/00; E01H 5/06
USPC ..... 701/1; 37/197, 231; 137/627.5; 285/256
See application file for complete search history.

(56) References Cited

U.S. PATENT DOCUMENTS 4,679,594 A * 7/1987 Fogg ..... B60T 15/046 137/627.5
2007/0152442 A1* 7/2007 Cleveland ..... F16L 13/143 285/256
2007/0271828 A1* 11/2007 Mishra ..... E01H 5/06 37/231
2010/0218401 A1* 9/2010 Mishra ..... E01H 5/066 37/197

(Continued)

OTHER PUBLICATIONS

DiCAN's Input Output Notification System (IONS) Brochure, Sep. 16, 2014, 2 pages, www.dicaninc.com.

(Continued)

*Primary Examiner* — Behrang Badii
*Assistant Examiner* — Sanjeev Malhotra
(74) *Attorney, Agent, or Firm* — Knobbe, Martens, Olson & Bear, LLP

(57) ABSTRACT

Systems and methods for reporting a position of an air-over-hydraulic road treatment element use pneumatically activated switches triggered by pilot air for moving the road treatment element. Switch activation electrical signals are used to determine whether the road treatment element is in an engaged configuration or a disengaged configuration. If the switch activation electrical signals indicate the engaged configuration, an engaged configuration electric signal can be maintained until the switch activation electrical signals indicate the disengaged configuration. Conversely, if the switch activation electrical signals indicate the disengaged configuration, a disengaged configuration electric signal can be maintained until the switch activation electrical signals indicate the engaged configuration. The engaged configuration electric signal can be maintained even after cessation of the switch activation electrical signals indicating the engaged configuration, and similarly the disengaged configuration electric signal can be maintained even after cessation of the switch activation electrical signals indicating the disengaged configuration.

30 Claims, 10 Drawing Sheets

(56) References Cited

U.S. PATENT DOCUMENTS

2014/0094994 A1* 4/2014 Menard ..... G08G 1/20
701/1

OTHER PUBLICATIONS

IONS—PPSA Specification Sheet, Sep. 16, 2014, 1 page, www.dicaninc.com.
DiCAN's Input Output Notification System (IONS), Product Description and Operation, Product Model No. PPSA-4, Sep. 1, 2015, 5 pages, www.dicaninc.com.

* cited by examiner

POSITION REPORTING FOR ROAD TREATMENT ELEMENTS

BACKGROUND

In snow plowing applications, liability issues may require that a municipality or other jurisdiction be able to demonstrate that a particular stretch of roadway was plowed. While the location of a snow plowing vehicle can be demonstrated by recorded GPS/AVL data, the GPS/AVL data alone is not sufficient because it does not prove whether the snow plow blade was up or down. For example, an operator may have raised the snow plow blade(s) when passing through an intersection with an already-plowed street; it is necessary to prove that the operator lowered the snow plow blade(s) after passing through the intersection.

A number of technologies have been used to detect snow plow blade position. Most commonly, proximity switches and hydraulic pressure switches have been used but these approaches have high failure rates. The proximity switches are positioned externally and may be damaged, and the hydraulic pressure switches are prone to seize up during the summer months when not in use.

Snow plows typically use "air-over-hydraulic" control systems to effect a change in a snow plow blade position. Levers are used by the operator to allow the flow of regulated air to "air-piloted-valves" which in turn pilot respective hydraulic directional control valves operating a hydraulic cylinder to raise or lower the snow plow blade.

DiCAN Inc., having an address at 1100 Burloak Drive, Suite 300, Burlington, Ontario, Canada L7L 6B2, has introduced a system in which the flow of regulated air to each air-piloted valve passes a pneumatically activated switch, which generates an electrical signal when regulated air is supplied. Thus, the electrical signal indicates that a pneumatic control signal ("raise" or "lower") has been applied to the hydraulic mechanism that controls the position of the plow blade, and this electrical signal can be transmitted to a GPS/AVL-equipped recording device so that the position of the plow blade at particular positions in a terrestrial coordinate frame ("geolocations") can be logged. This detection arrangement obviates the high failure rate associated with proximity switches and hydraulic pressure switches.

Most of the conventional GPS/AVL-equipped recording devices are configured for conventional blade position sensors (e.g. proximity switches and hydraulic pressure switches) and are therefore configured to require a continuous electrical signal as to the position of the snow plow blade. However, the original DiCAN system only generates an electrical signal while the snow plow blade is being moved, and not while it is in a static position. This is because the flow of regulated air (which causes the electrical signal) is only applied to the air-piloted valve while the snow plow blade is actually being raised or lowered; the flow of regulated air (and therefore the electrical signal) ceases when the snow plow blade is in the desired position and the operator releases the lever. As a result, the original DiCAN system is not compatible with conventional GPS/AVL-equipped recording devices, and requires a specially programmed GPS/AVL-equipped recording device which can continue to record a plow blade position after the electrical signal has ceased. The specially programmed GPS/AVL-equipped recording device also applies a "time delay" factor, requiring a signal from the position monitoring system to persist for a predetermined period so as to exclude false positives (e.g. if the operator bumps the lever).

Because the specially programmed GPS/AVL-equipped recording device requires a constant, persistent signal of predetermined duration before recording a change in plow position (e.g. from "up" to "down" or vice versa), in certain circumstances an actual change in plow position may not be recorded. An operator may make several small movements of a snow plow blade, each of which is of a sufficiently short duration as to avoid triggering recordal of a change in plow position but which are cumulatively sufficient to change the plow position. For example, three or four individual half-second movements of the lever may be sufficient to raise the snow plow blade more than a foot or two off the ground (effectively meaning the plow blade is "up" rather than "down"). However, because each movement generates a signal that is shorter than the predetermined duration set in the specially programmed GPS/AVL-equipped recording device, the actual change in position of the snow plow blade is not recorded. Although such circumstances are relatively rare, when they do occur, the recorded snow plow blade position data will be inaccurate.

Accordingly, while the original DiCAN position monitoring system represents an improvement over conventional snow plow blade position sensors (e.g. proximity switches and hydraulic pressure switches), it suffers from the disadvantage of requiring a specially programmed GPS/AVL-equipped recording device and may fail to record the occasional large position change resulting from a series of smaller changes.

BRIEF DESCRIPTION OF THE DRAWINGS

These and other features will become more apparent from the following description in which reference is made to the appended drawings wherein.

DETAILED DESCRIPTION

Figure 1:
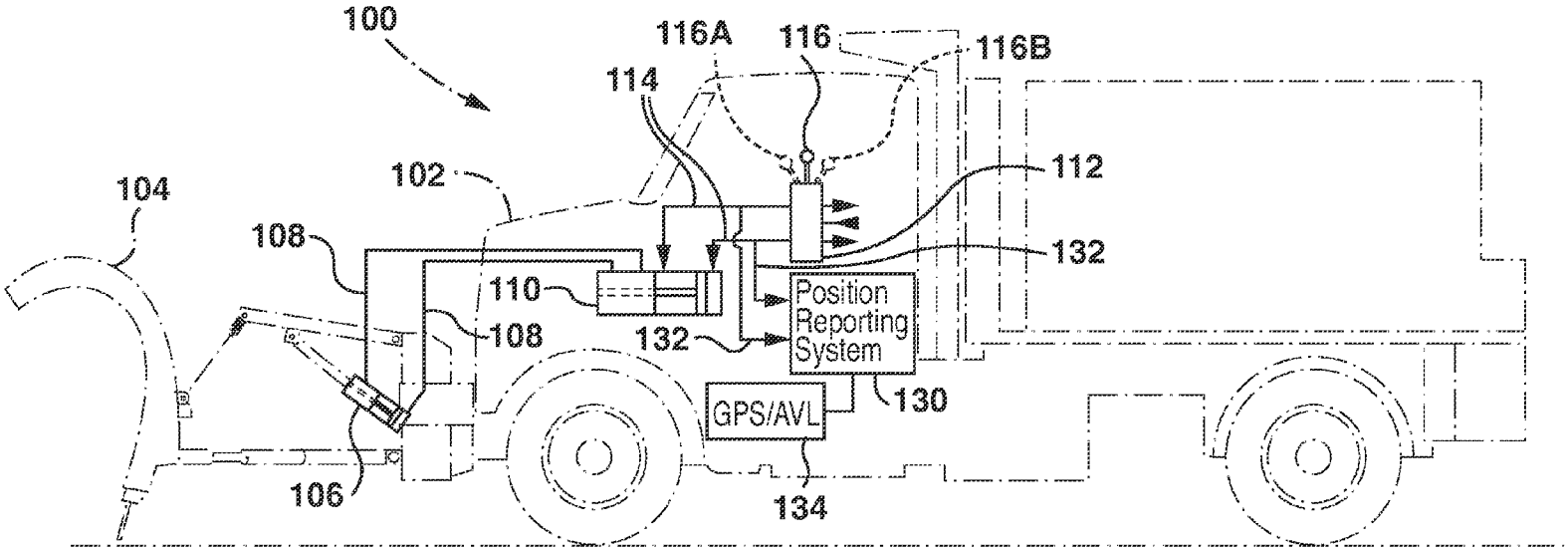
FIG. 1 shows a schematic representation of an exemplary snow plowing vehicle.

Reference is now made to FIG. 1, which shows a schematic representation of an exemplary snow plowing vehicle, indicated generally by reference 100. The exemplary snow plowing vehicle 100 takes the form of a truck 102 on which a movable front snow plow blade 104 and associated hydraulic and control equipment has been mounted. A double-acting hydraulic cylinder 106 acts between the front snow plow blade 104 and the front of the truck 102 to allow the front snow plow blade 104 to be raised and lowered. The hydraulic cylinder 106 is coupled by hydraulic lines 108 to an air-piloted hydraulic valve 110 which is coupled to a source of pressurized hydraulic fluid (not shown) for selectively supplying hydraulic fluid to the hydraulic cylinder 106 according to the position of the hydraulic valve 110. The position of the hydraulic valve 110 is determined by a directional control air valve 112, which is coupled to the hydraulic valve 110 by pilot air lines 114. The construction of the directional control air valve 112 is such that the supplied air will only flow to one pilot air line 114 at a time. The directional control air valve 112 is coupled to a source of pressurized air (not shown), typically at 100 to 125 psi through a filter-regulator-lubricator (FRL) unit (not shown). The directional control air valve 112 includes an "exhaust center" control lever 116, which is biased into the neutral position wherein the directional control air valve 112 will vent the supplied air to ambient. Moving the control lever 116 to a first position 116A causes the directional air control valve 112 to direct the supplied air to a first air inlet of the hydraulic valve 110, causing hydraulic fluid to flow to a first end of the hydraulic cylinder 106 to actuate the hydraulic cylinder 106 in a first linear direction. Conversely, moving the control lever 116 to a second position 116B causes the directional air control valve 112 to direct the supplied air to a second air inlet of the hydraulic valve 110, causing hydraulic fluid to flow to a second end of the hydraulic cylinder 106 to actuate the hydraulic cylinder 106 in a second linear direction. As is well known in the art, the construction of the directional control air valve 112 is such that the supplied air will only flow to one pilot air line 114 at a time. The truck 102, front snow plow blade 104, hydraulic cylinder 106, hydraulic lines 108, source of pressurized hydraulic fluid, air-piloted hydraulic valve 110, directional control air valve 112, pilot air lines 114 and control lever 106 are conventional and well-known to those of skill in the art, and therefore are not described further. Moreover, while the exemplary snow plowing vehicle 100 is shown as having only a front snow plow blade 104, this is merely for simplicity of illustration. One skilled in the art will appreciate that snow plowing vehicles may also include moveable side or "wing" snow plow blades and may further be coupled to a tow plow with its own movable snow plow blade, with the additional movable snow plow blades being integrated with the hydraulic and control equipment in known manner so as to provide one directional control air valve (with a respective exhaust center control lever) for each snow plow blade.

Continuing to refer to FIG. 1, the exemplary snow plowing vehicle 100 includes an exemplary position reporting system 130 for reporting a position of a road treatment element. The term "road treatment element", as used herein, refers to anything that is carried by a vehicle and moved into and out of engagement with a road surface to treat the road surface, including snow plow blades (whether mounted directly on the powered vehicle or on a trailer other towed appendage) and brushes of street sweepers. Accordingly, the term "engaged configuration" refers to a position of a road treatment element where the road treatment element effectively engages the road surface to perform its function (e.g. a position of a snow plow blade where the snow plow blade is close enough to the road surface that it is effectively plowing snow). Conversely, the term "disengaged configuration" refers to a position of a road treatment element that is sufficiently distant from the road surface so that the road treatment element no longer performs its function (e.g. a snow plow blade that is too high above the road surface to effectively plow snow). While the present description will, for simplicity of explanation, refer to snow plow blades as the exemplary type of road treatment element, it is to be understood that aspects of the teachings hereof may be applied to road treatment elements more generally.

The position reporting system 130 is connected in fluid communication with the pilot air lines 114 via air signal lines 132, and is in electrical communication with a GPS/AVL-equipped recording device 134. The GPS/AVL-equipped recording device 134 is conventional, and may be, for example, those offered under the trademark "Sentinel" by BSM aWireless Inc. (a wholly-owned subsidiary of BSM Technologies Inc.) having an address at 440 Boulevard Armand Frappier, Laval, Quebec, Canada H7V 4B4 or the DCD-II model offered under the trademark "ROADA" by DM&T Services Ltd. having an address at 75 East Beaver Creek Road, Unit 6, Richmond Hill, Ontario, Canada L4B 1B8. The position reporting system 130 may be connected to tubing at the control head manifold with an appropriate size of Y-connector and tubing (e.g. ⅛ inch, 5⁄32 inch or ¼ inch tubing). Typically, the components of the position reporting system 130 are contained within a protective enclosure (not shown) constructed from a suitable material, for example stainless steel, and located within the cab of the snow plowing vehicle 100. The protective enclosure preferably has suitable seals to inhibit infiltration of unwanted materials, such as dust, sand, salt, brine or even coffee spilled by an operator.

Figure 2:
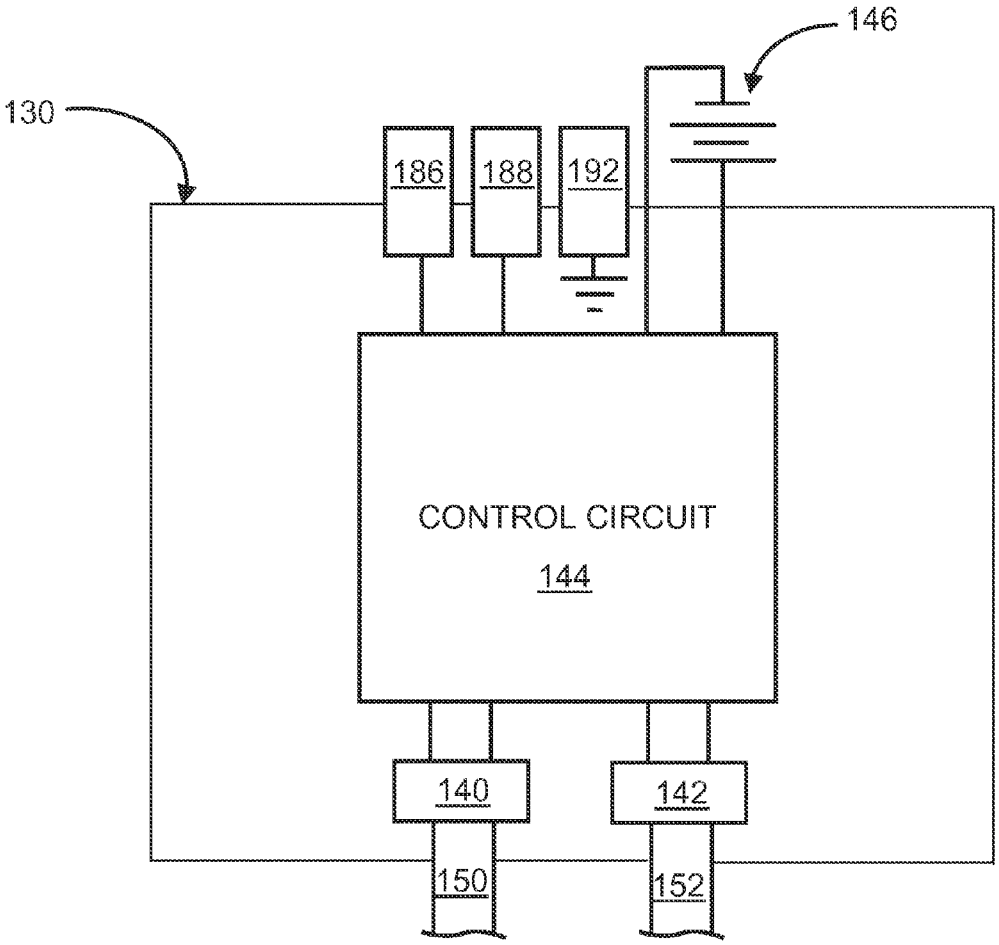
FIG. 2 is a block diagram of a first position reporting system.

Reference is now made to FIG. 2, which shows a more detailed representation of the position reporting system 130 in the form of a block diagram. The position reporting system 130 comprises a pair of pneumatically activated switches 140, 142 and a control circuit 144 which is connectible in electrical communication with a power source. In the illustrated embodiment, the control circuit 144 is in electrical communication with the vehicle power system 146. Each of the pneumatically activated switches 140, 142 is pneumatically coupled to a respective pilot air input 150, 152, and is electrically coupled to the control circuit 144 to provide a respective switch activation electrical signal to the control circuit 144 when a flow of pilot air activates that pneumatically activated switch 140, 142. Thus, the control circuit 144 can receive switch activation electrical signals from the pneumatically activated switches 140, 142. The position reporting system 130 also includes output terminals 186, 188 that are electrically coupled to the control circuit 144 and may be connected in electrical communication with a suitable a GPS/AVL-equipped recording device (e.g. GPS/AVL-equipped recording device 134 in FIG. 1) to provide output signals from the control circuit 144 as described further below. The position reporting system 130 also includes a ground terminal 192.

The pilot air inputs 150, 152 are associated with an air-over-hydraulic snow plow blade (e.g. snow plow blade 104 in FIG. 1) by way of coupling to the pilot air lines (e.g. pilot air lines 114 via air signal lines 132 as shown in FIG. 1) that control the hydraulic valve and hydraulic cylinder (e.g. hydraulic valve 110 and hydraulic cylinder 106 in FIG. 1) used to raise and lower the snow plow blade. Accordingly, the pair of pneumatically activated switches 140, 142 is also associated with the air-over-hydraulic snow plow blade 104. In particular, within the pair of pneumatically activated switches 140, 142, a first one of the pneumatically activated switches 140 is pneumatically coupled to a first pilot air source associated with movement of the snow plow blade toward an engaged configuration (e.g. one of the pilot air lines 114 via one of the air signal lines 132 and the pilot air input 150) so as to generate a first switch activation electrical signal indicating movement of the snow plow blade (e.g. snow plow blade 104 in FIG. 1) toward the engaged configuration. Similarly, within the pair of pneumatically activated switches 140, 142, a second one of the pneumatically activated switches 142 is pneumatically coupled to a second pilot air source associated with movement of the road treatment element toward a disengaged configuration (e.g. the other one of the pilot air lines 114 via the other one of the air signal lines 132 and the pilot air input 152) so as to generate a second switch activation electrical signal indicating movement of the road treatment element toward the disengaged configuration. As noted above, the construction of the directional control air valve 112 is such that the supplied air will only flow to one pilot air line 114 at a time, so only one of the pneumatically activated switches 140, 142 can be activated at any given time (it is also possible that neither of the pneumatically activated switches 140, 142 may be activated, i.e. when the control lever 116 (FIG. 1) is biased in the neutral position).

The control circuit 144 is configured to, for each pair of pneumatically activated switches, use the switch activation electrical signals to determine whether the snow plow blade associated with that pair of pneumatically activated switches is in an engaged configuration or a disengaged configuration. Responsive only to the switch activation electrical signals indicating that the snow plow blade is in the engaged configuration, the control circuit 144 initiates an engaged configuration electric signal and maintains the engaged configuration electric signal until the switch activation electrical signals indicate that the road treatment element is in the disengaged configuration. Conversely, responsive only to the switch activation electrical signals indicating that the road treatment element is in the disengaged configuration, the control circuit 144 initiates a disengaged configuration electric signal and maintains the disengaged configuration electric signal until the switch activation electrical signals indicate that the road treatment element is in the engaged configuration. Importantly, the control circuit is configured so that the engaged configuration electric signal is maintained even after cessation of the switch activation electrical signals indicating that the snow plow blade is in the engaged configuration, and similarly the disengaged configuration electric signal is maintained even after cessation of the switch activation electrical signals indicating that the snow plow blade is in the disengaged configuration The control circuit 144 is configured so that the engaged configuration electric signal and the disengaged configuration electric signal are mutually exclusive.

Figure 2A:
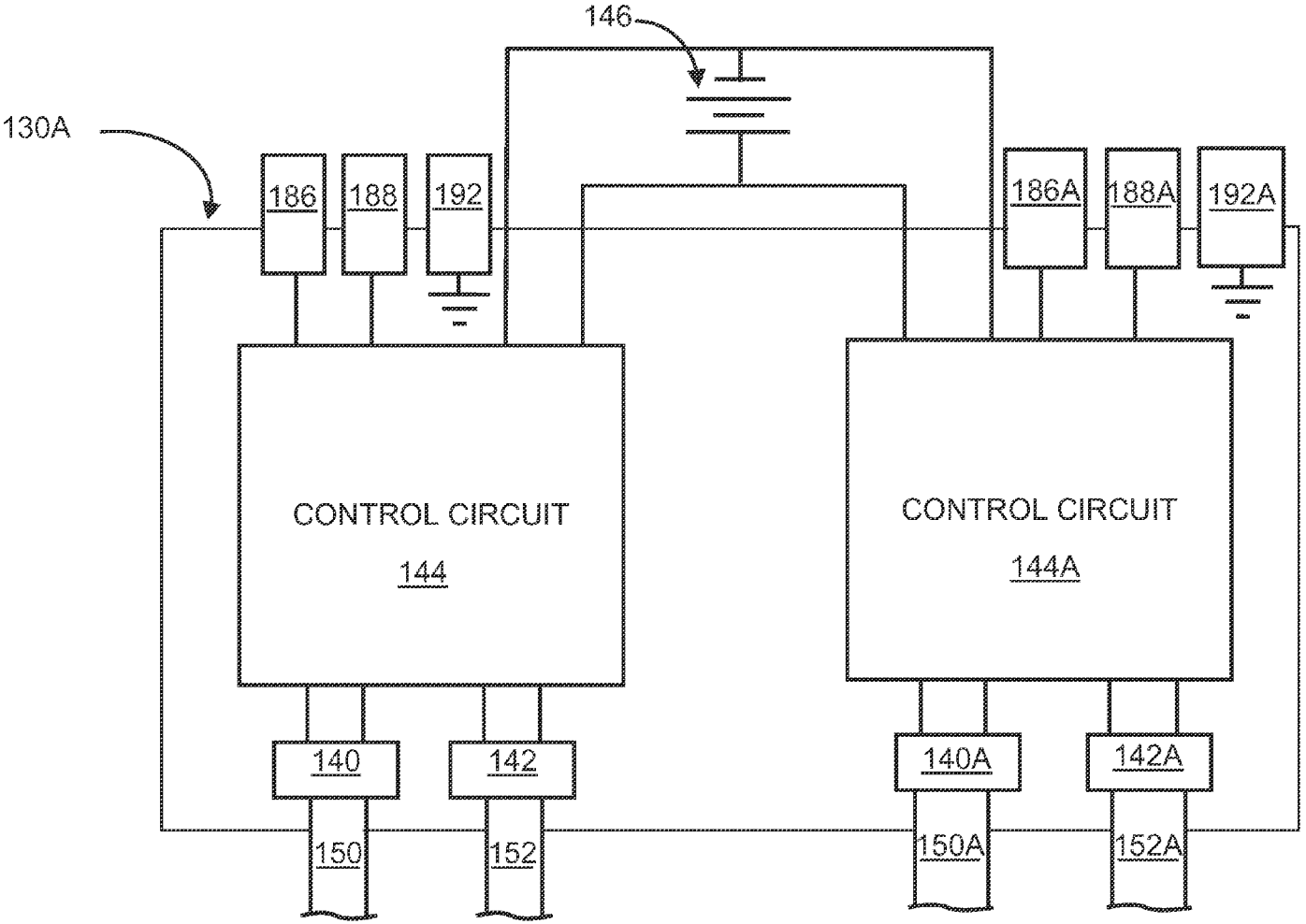
FIG. 2A is a block diagram of a second position reporting system.

As noted above, in addition to a front-mounted plow, snow plowing vehicles may also include moveable side or "wing" snow plow blades and may further be coupled to a tow plow with its own movable snow plow blade. Additional air-over-hydraulic snow plow blades can be accommodated by providing one or more pairs of additional pneumatically activated switches, with one pair of pneumatically activated switches for each air-over-hydraulic snow plow blade. FIG. 2A shows an exemplary position reporting system 130A which can accommodate a snow plowing vehicle having two air-over-hydraulic snow plow blades. The exemplary position reporting system 130A shown in FIG. 2A essentially comprises two distinct instances of the position reporting system 130 shown in FIG. 2, with one instance for each air-over-hydraulic snow plow blade. The position reporting system 130A shown in FIG. 2A comprises first and second pairs of pneumatically activated switches 140, 142 and 140A, 142A and respective first and second control circuits 144, 144A connected in parallel electrical communication with the vehicle power system 146. Each of the pneumatically activated switches 140, 142 and 140A, 142A is pneumatically coupled to a respective pilot air input 150, 152 and 150A, 152A, and is electrically coupled to the respective control circuit 144, 144A to provide a respective switch activation electrical signal to the respective control circuit 144, 144A upon receiving a flow of pilot air. Thus, the first control circuit 144 can receive switch activation electrical signals from the first pair of pneumatically activated switches 140, 142 and the second control circuit 144A can receive switch activation electrical signals from the second pair of pneumatically activated switches 140A, 142A. The position reporting system 130A also includes first and second sets of output terminals 186, 188 and 186A, 188A that are electrically coupled to the first and second control circuits 144, 144A, respectively, and first and second ground terminals 192, 192A. The control circuits 144, 144A are configured so that, for each pair of pneumatically activated switches, the engaged configuration electric signal and the disengaged configuration electric signal are mutually exclusive.

While the exemplary position reporting system 130A shown in FIG. 2A can accommodate two air-over-hydraulic snow plow blades, a third air-over-hydraulic snow plow blade could be accommodated by providing a third instance of the position reporting system 130 shown in FIG. 2, and so on.

The arrangement shown in FIG. 2A contemplates separate control circuits 144, 144A for each pair of pneumatically activated switches 140A, 142A, with each control circuit 144, 144A using the switch activation electrical signals from its respective pair of pneumatically activated switches to determine whether the snow plow blade associated with that pair of pneumatically activated switches is in an engaged configuration or a disengaged configuration. In alternate embodiments, a single control circuit may be used for all pairs of pneumatically activated switches. For example, a single control circuit may comprise two or more microcontrollers, with each pair of pneumatically activated switches being coupled to a different one of the microcontrollers.

Figure 3:
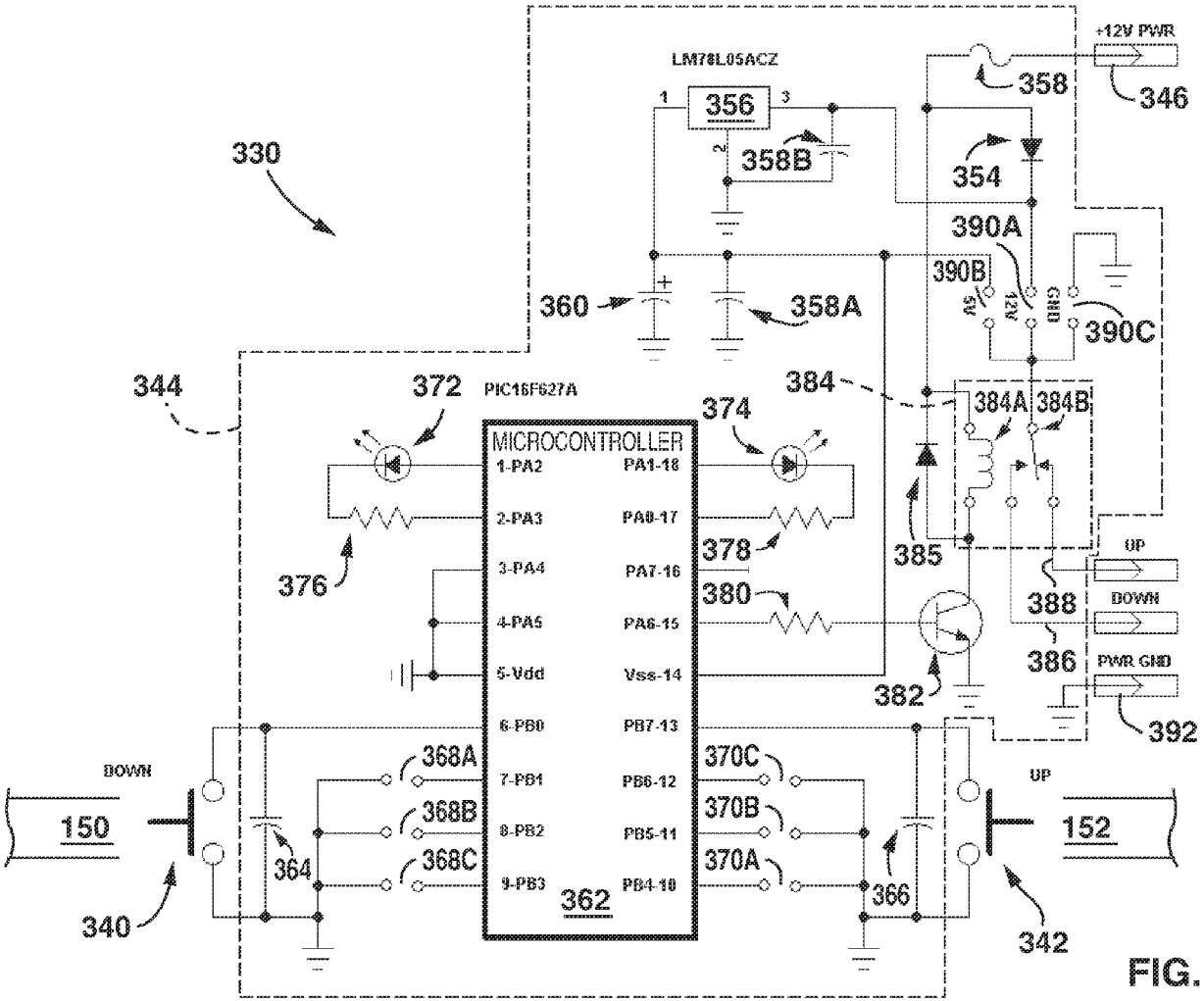
FIG. 3 is an exemplary electronic schematic diagram for a position reporting system.

Reference is now made to FIG. 3, which shows an exemplary electronic schematic diagram for a position reporting system, indicated generally by reference 330. The position reporting system 330 represents one exemplary implementation of the position reporting system 130 described above. The position reporting system 330 comprises a pair of pneumatically activated pressure switches 340, 342 which can be pneumatically coupled to respective pilot air inputs (e.g. pilot air inputs 150, 152) and a control circuit, indicated generally by reference 344, which is connectible in electrical communication with a 12V power source 346, typically the electrical system of a plowing vehicle. A fuse 348 is interposed between the power source 346 and the remainder of the control circuit 348 to provide over-current protection, and a DC supply steering diode 354 provides reverse polarity current protection.

Current from the power source 346 flows to a voltage regulator 356, which is coupled to grounded oscillation prevention capacitors 358A and 358B, and to a grounded bulking capacitor 360. The voltage regulator 356, which in the illustrated embodiment is an LM78L05ACZ voltage regulator, converts the supplied 12V voltage to 5V for operation of a suitably programmed microcontroller 362 forming part of the control circuit 344. In the illustrated embodiment, the microcontroller 362 is a PIC16F627A microcontroller, and the 5V voltage is delivered to the VSS pin thereof, with the PA4, PA5 and VDD pins grounded.

In the exemplary electronic schematic diagram shown in FIG. 3, the pressure switch 340 on the left side of the diagram is associated with "down" movement of a snow plow blade and would be coupled to the pilot air line used to move the snow plow blade toward the surface being plowed; it is referred to as the "plow down" pressure switch 340 to distinguish it from the other pressure switch 342 on the right side of the diagram. Conversely, the pressure switch 342 on the right side of the diagram is associated with "up" movement of a snow plow blade and would be coupled to the pilot air line used to move the snow plow blade away from the surface being plowed; it is referred to for convenience as the "plow up" pressure switch 342, thereby distinguishing it from the "plow down" pressure switch 340. Respective de-bounce capacitors 364, 366 are connected in parallel with the "plow down" pressure switch 340 and the "plow up" pressure switch 342. Each of the pneumatically activated pressure switches 340, 342 is electrically coupled to microcontroller 362.

The "plow down" pressure switch 340 is connected to the PB0 pin of the microcontroller 362 and to ground and, if one or more of three timing jumpers 368A, 368B, 368C is set, to the PB1, PB2 and/or PB3 pin, respectively, of the microcontroller 362. Similarly, the "plow up" pressure switch 342 is connected to the PB7 pin of the microcontroller 362 and to ground and, one or more of three timing jumpers 370A, 370B, 370C is set, to the PB4, PB5 and/or PB6 pin, respectively, of the microcontroller 362. Accordingly, when airflow from a respective pilot air input closes one of the pressure switches 340, 342, that pressure switch 340, 342 will provide a respective switch activation electrical signal to the microcontroller 362. The timing jumpers 368A, 368B, 368C and 370A, 370B, 370C are used to control processing by the microcontroller 362 of the signals from the pressure switches 340, 342 as described further below.

Respective two-color LEDs 372, 374 are associated with the pressure switches 340, 342; a "plow down" LED 372 is associated with the "plow down" pressure switch 340 and a "plow up" LED 374 is associated with the "plow up" pressure switch 342. The LEDs 372, 374 are optional, and can be used to provide visual information describing plow blade movement based on the signals received by the microcontroller 362 from the pressure switches 340, 342, or to provide diagnostic information. The "plow down" LED 372 is coupled to the PA2 and PA3 pins of the microcontroller 362 in series with a resistor 376 and the "plow up" LED 374 is coupled to the PA0 and PA1 pins of the microcontroller 362 in series with a resistor 378.

The output signal from the exemplary position reporting system 330 is determined by the output from the PA6 pin of the microcontroller 362. The signal from the PA6 pin of the microcontroller 362 passes through a resistor 380 to the base of a relay drive transistor 382 (which also acts as a current buffer). The collector of the relay drive transistor 382 is coupled to the coil 384A of an output indicator relay coil 384, which is in turn coupled, in parallel with a back EMF protector diode 386, to the 12V power source 346. The emitter of the relay drive transistor 382 is coupled to ground. Thus, when the signal from the PA6 pin of the microcontroller 362 is received at the base of the relay drive transistor 382, a current will flow through the coil 384A, inducing an electromagnetic field which moves a physical switch 384B of the output indicator relay coil 384 from a first (or default) position to a second position. The physical switch 384B of the output indicator relay coil 384 will remain in the second position for as long as the signal from the PA6 pin of the microcontroller 362 is received at the base of the relay drive transistor 382. When no signal is received at the base of the relay drive transistor 382, no current (or more precisely negligible current) will flow through the coil 384A and the physical switch 384B of the output indicator relay coil 384 remains in the first (default) position. The position of the physical switch 384B of the output indicator relay coil 384 will determine whether an output signal is maintained at the "plow down" output terminal 386 or the "plow up" output terminal 388. The output terminals 386, 388 may be connected by suitable electrical coupling to an appropriate recording device, for example a conventional GPS/AVL-equipped recording device. Thus, the control circuit 344 has two output terminals, in this case the "plow down" output terminal 386 and the "plow up" output terminal 388, for each pair of pneumatically activated switches, in this case pressure switches 340, 342. The control circuit 344 is also provided with a ground terminal 392. The binary nature of the output indicator relay coil 384 is such that a signal can only be applied to one of the output terminals 386, 388 at a time. Applying a signal to the "plow down" output terminal 386 will signify that the road treatment element is down and engaged with the road surface, i.e. in an engaged configuration, and hence a signal at the "plow down" output terminal 386 is an engaged configuration electric signal. Conversely, applying a signal to the "plow up" output terminal 388 will signify that the road treatment element is up and is disengaged from the road surface, and hence a signal at the "plow up" output terminal 388 is a disengaged configuration electric signal.

The exemplary position reporting system 330 shown in FIG. 3 has three different output modes for indicating the position of a snow plow blade: 12V positive signal, 5V CMOS signal, and ground signal (for use with a pull-up resistor configuration). The desired output mode can be selected by setting the appropriate output mode jumper 390A, 390B, 380C. If the 12V jumper 390A is set, a 12V signal flows from the 12V power source 346 through the DC supply steering diode 354 to the physical switch 384B of the output indicator relay coil 384. Similarly, if the 5V jumper 390B is set, a 5V signal flows from the voltage regulator 356 to the physical switch 384B of the output indicator relay coil 384. Depending on the position of the physical switch 384B, the signal (12V if the 12V jumper 390A is set or 5V if the 5V jumper 390B is set) flows to either the "plow down" output terminal 386 or the "plow up" output terminal 388. Thus, in both the 12V positive signal mode and the 5V CMOS signal mode, the engaged configuration electric signal comprises applying a voltage only to one of the output terminals, namely the "plow down" output terminal 386, and the disengaged configuration electric signal comprises applying a voltage only to the other output terminal, namely the "plow up" output terminal 388.

If the ground jumper is set, the position of the physical switch 384B of the output indicator relay coil 384 will determine whether the "plow down" output terminal 386 or the "plow up" output terminal 388 is grounded. Thus, in the ground signal configuration, the engaged configuration electric signal comprises grounding only one of the output terminals, namely the "plow down" output terminal 386, and the disengaged configuration electric signal comprises grounding only the other output terminal, namely the "plow up" output terminal 388.

Accordingly, the microcontroller 362 receives input signals from the pressure switches 340, 342 and executes logic to determine a binary output signal, which in turn determines whether the control circuit 344 maintains an engaged configuration electric signal (i.e. a signal at the "plow down" output terminal 386) or a disengaged configuration electric signal (i.e. a signal at the "plow up" output terminal 388) is maintained. Moreover, the determined output signal is maintained continuously, even after cessation of the relevant switch activation electrical signal ceases, so that the output signals are suitable for use with conventional GPS/AVL-equipped recording devices configured to require a continuous electrical signal as to the position of the plow blade.

Exemplary implementations of logic that may be executed by the microcontroller 362 will now be described.

As noted above, a first one of the pneumatically activated switches will generate a first switch activation electrical signal indicating movement of the road treatment element toward the engaged configuration (e.g. "plow down" pressure switch 340) and a second one of the pneumatically activated switches (e.g. "plow up" pressure switch 342) will generate a second switch activation electrical signal indicating movement of the road treatment element toward the disengaged configuration. In some exemplary implementations, the logic assesses the switch activation electrical signals individually. In such implementations, the control circuit 344 is configured (e.g. the microcontroller 362 is programmed) so that the switch activation electrical signals indicate that the road treatment element is in the engaged configuration when the first switch activation electrical signal satisfies a first predetermined position change threshold, and the switch activation electrical signals indicate that the road treatment element is in the disengaged configuration when the second switch activation electrical signal satisfies a second predetermined position change threshold.

Figure 4:
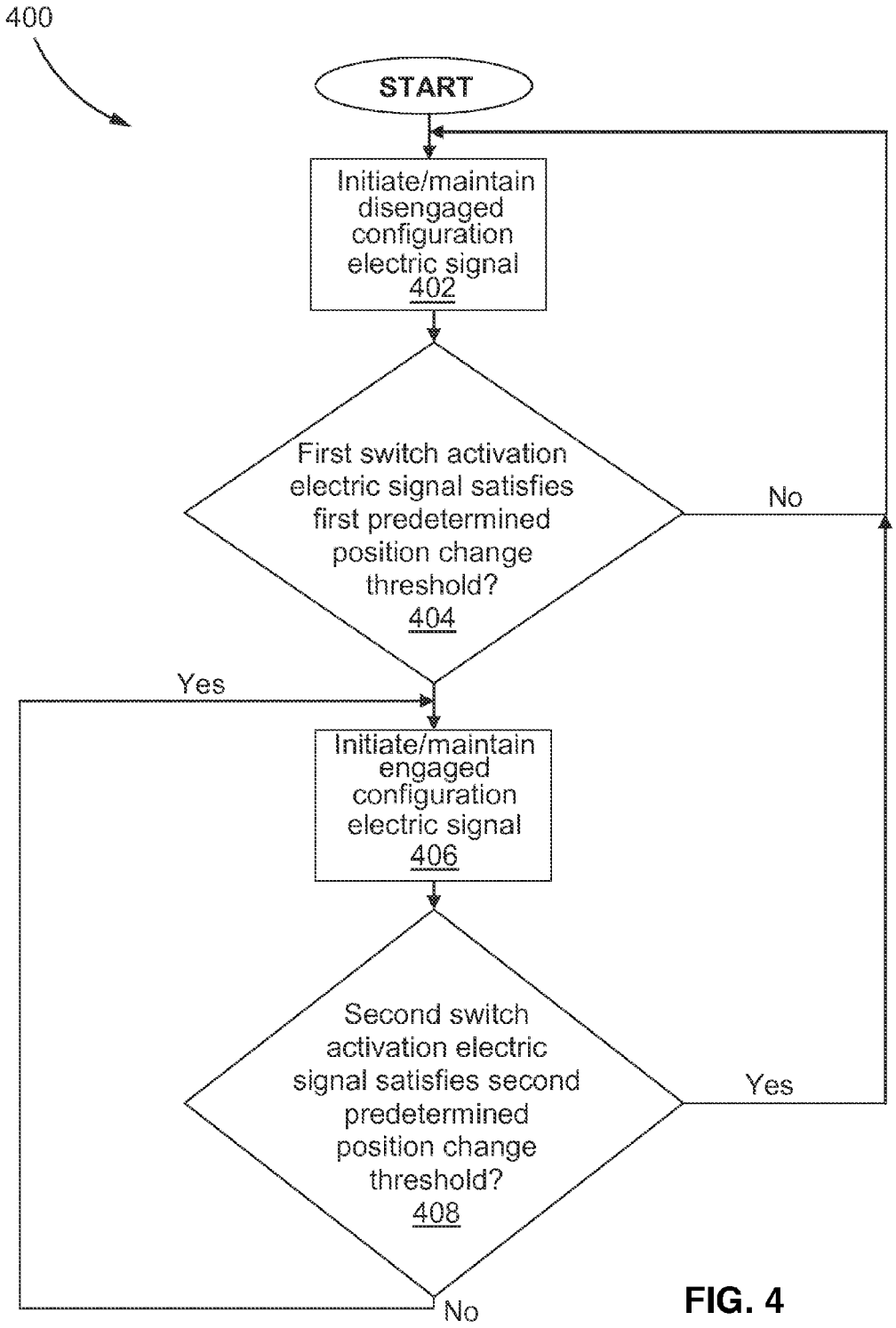
FIG. 4 is a flow chart showing first exemplary logic for a control circuit of a position reporting system.

Reference is now made to FIG. 4, which is a flow chart 400 showing exemplary logic which may be executed by the microcontroller 362 in an implementation where the switch activation electrical signals are assessed individually. Step 402 is first carried out as an initialization step when the microcontroller 362 is activated, i.e. upon receiving electrical power via the 12V power source 346. Typically this will occur when the engine of the road treatment vehicle (e.g. snow plow) is turned on and the road treatment vehicle's electrical system begins to supply electrical power. According to normal operating procedures, snow plowing vehicles are parked with the snow plow blade(s) fully raised; the snow plow blade(s) should therefore normally be in the raised position when the microcontroller 362 is activated. Accordingly, in a preferred embodiment the microcontroller 362 will, when first powered on, initiate and maintain a disengaged configuration electric signal at step 402.

At step 404, the microcontroller 362 checks whether the first switch activation electrical signal satisfies a first predetermined position change threshold. If the first switch activation electrical signal satisfies the first predetermined position change threshold (a "yes" at step 404), this means that the switch activation electrical signals indicate that the road treatment element has moved to the engaged configuration and the microcontroller 362 then proceeds to step 406. At step 406, the microcontroller 362 initiates (or maintains if already initiated) the engaged configuration electric signal. If the first switch activation electrical signal does not satisfy the first predetermined position change threshold (a "no" at step 404), the microcontroller 362 returns to step 402 to maintain the disengaged configuration electric signal and then returns to step 404. Thus, the microcontroller 362 will maintain the disengaged configuration electric signal at step 402 unless and until the first switch activation electrical signal satisfies the first predetermined position change threshold at step 404, i.e. until the switch activation electrical signals indicate that the road treatment element has moved to the engaged configuration.

After step 406, the microcontroller 362 proceeds to step 408 to check whether the second switch activation electrical signal satisfies a second predetermined position change threshold. If the second switch activation electrical signal does not satisfy the second predetermined position change threshold (a "no" at step 408), the microcontroller 362 returns to step 406 to maintain the engaged configuration electric signal and then returns to step 408. If the second switch activation electrical signal satisfies the second predetermined position change threshold (a "yes" at step 408), this means that the switch activation electrical signals indicate that the road treatment element has moved to the disengaged configuration and the microcontroller 362 then returns to step 402 to initiate the disengaged configuration electric signal. Thus, after the first switch activation electrical signal satisfies the first predetermined position change threshold at step 404, the microcontroller 362 will maintain the engaged configuration electric signal at step 406 unless and until the second switch activation electrical signal satisfies the second predetermined position change threshold at step 408, i.e. until the switch activation electrical signals indicate that the road treatment element has moved to the disengaged configuration.

The predetermined position change thresholds may be satisfied in a number of ways. In one embodiment, the control circuit 344 may be configured (e.g. the microcontroller 362 may be programmed) so that the first predetermined position change threshold is satisfied by the first switch activation electrical signal persisting for a first predetermined continuous duration and the second predetermined position change threshold is satisfied by the second switch activation electrical signal persisting for a second predetermined continuous duration. In such an embodiment, the output signal (engaged configuration electric signal or disengaged configuration electric signal) would only change if the relevant pressure switch 340, 342 was closed long enough to indicate sufficient movement of the snow plow blade.

For example, if it takes two seconds to lower the snow plow blade from a fully upright position, the first predetermined position change threshold may be satisfied by a continuous duration of at least two seconds. If at the beginning of a run the operator moves the lever to lower the snow plow blade for two seconds or more, the flow of pilot air will close the "plow down" pressure switch 340 for long enough to satisfy the first predetermined position change threshold (a "yes" at step 404) and the output signal would change from the disengaged configuration electric signal to the engaged configuration electric signal. However, if the operator only lowered the snow plow blade for one second, which would in the present example be insufficient to move the snow plow blade from a fully upright position into the engaged configuration, the first predetermined position change threshold would not be satisfied (a "no" at step 404) and the disengaged configuration electric signal would be maintained at step 402.

Conversely, consider the case where the snow plow blade is fully lowered, with the engaged configuration electric signal active. If the operator moves the lever to raise the snow plow blade for less than the second predetermined continuous duration (e.g. to clear a raised manhole), the flow of pilot air will not close the "plow up" pressure switch 342 for long enough to satisfy the second predetermined position change threshold. This results in a "no" at step 408, and the engaged configuration electric signal is maintained at step 406. However, if the operator moves the lever to raise the snow plow blade for longer than the second predetermined continuous duration, the flow of pilot air will close the "plow up" pressure switch 342 for long enough to satisfy the second predetermined position change threshold (a "yes" at step 408), and the output signal will revert to the disengaged configuration electric signal at step 402.

Typically, where the predetermined position change thresholds are satisfied by the respective switch activation electrical signal persisting for respective predetermined continuous durations, the first predetermined continuous duration will be shorter than the second predetermined continuous duration. With most air-over hydraulic snow plowing systems, it takes significantly less time to lower the snow plow blade by a given amount than to raise it by the same amount, i.e. the snow plow blade can be lowered more quickly than it can be raised. There are several reasons for this, including the effect of gravity and the nature of the hydraulic system. The first predetermined continuous duration can be set equal to the amount of time required to lower the snow plow blade from a fully raised position to a fully lowered position, for example about one second. Even if the snow plow blade is being lowered from only a partially raised position, when an operator deliberately moves the control lever (e.g. control lever 116) to lower the snow plow blade, he or she will likely maintain the control lever in position (and hence close the "plow down" pressure switch 340) for long enough to exceed the first predetermined continuous duration. Moreover, an operator can be trained to do so.

The second predetermined continuous duration would typically not be set equal to the amount of time required to raise the snow plow blade from a fully lowered position to a fully raised position, but rather to a fraction of this time. This is because the snow plow blade does not need to be raised to a fully upright position to be in a disengaged configuration, but only high enough that it is no longer effectively plowing. As such, the second predetermined continuous duration is preferably set to an amount of time corresponding to raising the snow plowing blade from an engaged configuration to a disengaged configuration in which it is no longer effectively plowing. For example, if about five seconds were required to raise the snow plow blade from a fully lowered position to a fully raised position, the second predetermined continuous duration could be set to about two seconds.

The values assigned to the first predetermined continuous duration and the second predetermined continuous duration will depend on the particular snow plow blade and hydraulic system, and can be set using the timing jumpers 368A, 368B, 368C, 370A, 370B, 370C. For example, in one embodiment the jumpers can permit the predetermined continuous durations to be set at 0.5 seconds, 1.0 seconds, 1.5 seconds or 2.0 seconds.

The logic illustrated in FIG. 4 can also account for so-called "feathering", where an operator makes a series of small consecutive movements which, although individually relatively small, may cumulatively be large enough to move the snow plow blade from the engaged configuration to the disengaged configuration or vice versa. In such embodiments, the first predetermined position change threshold is satisfied by a first predetermined cumulative duration of a consecutive sequence of discrete instances of the first switch activation electrical signal and the second predetermined position change threshold is satisfied by a second predetermined cumulative duration of a consecutive sequence of discrete instances of the second switch activation electrical signal. Thus, using one second as an example duration for lowering the snow plow blade, the first predetermined position change threshold would be satisfied by either a single continuous first switch activation electrical signal having a duration of at least one second, or by a series of consecutive first switch activation electrical signals having a total duration of at least one second. Similarly, using two seconds as an example duration for raising the snow plow blade, the second predetermined position change threshold would be satisfied by either a single continuous second switch activation electrical signal of at least two seconds, or by a series of consecutive second switch activation electrical signals having a total duration of at least two seconds. If a series of first switch activation electrical signals were interrupted by a second switch activation electrical signal, or vice versa, the accumulation of time would be reset. The predetermined cumulative duration of the consecutive sequence of discrete instances of the first switch activation electrical signal (the first predetermined cumulative duration) would typically be shorter than the predetermined cumulative duration of the consecutive sequence of discrete instances of the second switch activation electrical signal (the second predetermined cumulative duration). As with the predetermined continuous duration embodiment, the values assigned to the first predetermined cumulative duration and the second predetermined cumulative duration will depend on the particular snow plow blade and hydraulic system, and can be set using the timing jumpers 368A, 368B, 368C, 370A, 370B, 370C (e.g. 0.5 seconds, 1.0 seconds, 1.5 seconds or 2.0 seconds).

The logic illustrated in FIG. 4 can further account for "feathering" by counting the total number of consecutive movements, independently of the individual or cumulative duration of those movements. In such an embodiment, the first predetermined position change threshold is satisfied by a predetermined number of consecutive discrete instances of the first switch activation electrical signal, and the second predetermined position change threshold is satisfied by a predetermined number of consecutive discrete instances of the second switch activation electrical signal. The predetermined number of consecutive discrete instances of the first switch activation electrical signal may be smaller than the predetermined number of consecutive discrete instances of the second switch activation electrical signal.

In addition, the above-described techniques may be combined. For example, the control circuit 344 may be configured (e.g. the microcontroller 362 may be programmed) so that the first predetermined position change threshold is satisfied by any one of (a) the first switch activation electrical signal persisting for a first predetermined continuous duration; (b) a first predetermined cumulative duration of a consecutive sequence of discrete instances of the first switch activation electrical signal; or (c) by a predetermined number of consecutive discrete instances of the first switch activation electrical signal, and the second predetermined position change threshold is satisfied by any one of (a) the second switch activation electrical signal persisting for a second predetermined continuous duration; (b) a second predetermined cumulative duration of a consecutive sequence of discrete instances of the second switch activation electrical signal; or (c) by a predetermined number of consecutive discrete instances of the second switch activation electrical signal.

As an alternative to logic whereby the switch activation electrical signals are assessed individually, the switch activation electrical signals may be assessed collectively.

In one exemplary embodiment, the microcontroller 362 is configured to use the switch activation electrical signals to determine a current index position for the pair of pneumatically activated switches 340, 342 and to use the current index position to determine whether the switch activation electrical signals indicate that the road treatment element is in the engaged configuration or the disengaged configuration. The index position can be seen as an estimate or approximation of the position of the road treatment element relative to the road surface. The microcontroller 362 may use the switch activation electrical signals to determine a current index position for the pair of pneumatically activated switches 340, 342 based on a number of timing cycles during which the respective pneumatically activated switches 340, 342 are closed. For example, the microcontroller may increment the current index position according to the number of timing cycles during which the "plow up" pressure switch 342 is closed and decrement the current index position according to the number of timing cycles during which the "plow down" pressure switch 340 is closed. This approach is preferred as it logically correlates decrementing the index position with lowering the snow plow blade and incrementing the index position with raising the snow plow blade; equivalently, the index position could be decremented as the snow plow blade is raised and incremented as the snow plow blade is lowered. As noted above, the construction of the directional control air valve is such that the supplied air will only flow to one pilot air line at a time, and hence the configuration/programming of the microcontroller 362 can be based on the assumption that only one of the pneumatically activated switches 340, 342 will be closed at any given time.

Within the programming of the microcontroller 362, an index range may be defined, with the index position being constrained to fall within the index range. For example, the index range may be from 0 to 200, and the microcontroller may be programmed to reset the index position to 0 if the number of timing cycles during which the "plow down" pressure switch 340 is closed would otherwise decrement below 0 and conversely to reset the index position to 200 if the number of timing cycles during which the "plow up" pressure switch 342 is closed would otherwise decrement above 100.

As noted above, the nature of the air-over-hydraulic system is such that a snow plow blade can typically be lowered at a faster rate than it can be raised. As such, air supplied for the same time period will result in different amounts of movement of the snow plow blade depending on which air inlet of the hydraulic valve receives the supplied air (i.e. whether the snow plow blade is being raised or lowered). Because the index position is used as a proxy for the position of the snow plow blade, in preferred embodiments the control circuit 344 is configured so that the microcontroller 362 can selectively execute timing cycles at different rates for each pneumatically activated switch 342, 344. The timing cycle rates are preferably selected so that the duration of a timing cycle for the "plow down" pressure switch 340 and the duration of a timing cycle for the "plow up" pressure switch 342, although different from one another, correspond to approximately the same magnitude of movement of the snow plow blade. Thus, incrementing the position index and decrementing the position index will both will correspond to an approximately uniform magnitude of movement of the snow plow blade.

The timing cycles comprise delay loops implemented in firmware. In embodiments where the switch activation electrical signals are assessed collectively, the timing jumpers 368A, 368B, 368C, 370A, 370B, 370C may be used to control the timing cycle duration. For the "plow down" pressure switch 340, the default timing cycle duration, if none of the timing jumpers 368A, 368B, 368C is set, is a preset base value. Setting only the timing jumper 368A coupled to the PB1 pin adds 1 multiplied by the base value (i.e. double the base value), setting only the timing jumper 368B coupled to the PB2 pin adds 2 multiplied by the base value (i.e. triple the base value) and setting only the timing jumper 368C coupled to the PB3 pin adds 4 multiplied by the base value (i.e. quintuple the base value). Similarly, for the "plow up" pressure switch 342 a preset default base value is used for the timing cycle duration if none of the timing jumpers 370A, 370B, 370C is set, and setting one of the timing jumpers 370A, 370B, 370C adds a multiplier multiplied by the base value. Setting only the timing jumper 370C coupled to the PB6 pin adds 1 multiplied by the base value (i.e. double the base value), setting only the timing jumper 370B coupled to the PB5 pin adds 2 multiplied by the base value (i.e. triple the base value) and setting only the timing jumper 370A coupled to the PB4 pin adds 4 multiplied by the base value (i.e. quintuple the base value). It is also possible to use more than one timing jumper for a given pressure switch 340, 342. For example, setting both the timing jumper 368A coupled to the PB1 pin and the timing jumper 368C coupled to the PB3 pin would add 1 multiplied by the base value and 4 multiplied by the base value, respectively, for a total of six times the base value (i.e. base value+(base value×1)+(base value×4)). The timing jumpers 368A, 368B, 368C, 370A, 370B, 370C can be selected and set when the position reporting system 330 is installed; the installer can observe the amount of time required to raise and lower the snow plow blade and set the timing jumpers 368A, 368B, 368C, 370A, 370B, 370C accordingly. The timing jumpers 368A, 368B, 368C, 370A, 370B, 370C may be set so that raising the snow plow blade by a given amount will result in approximately the same number of timing cycles being counted for the "plow up" pressure switch 342 as would be counted for the "plow down" pressure switch 340 when lowering the snow plow blade by the same amount.

The control circuit 344, and in particular the microcontroller 362, is preferably configured to initialize the value of the index position when the microcontroller 362 is activated, i.e. upon receiving electrical power via the 12V power source 346, typically this will occur when the engine of the road treatment vehicle (e.g. snow plow) is turned on and the road treatment vehicle's electrical system begins to supply electrical power. As noted above, snow plowing vehicles are normally parked with the snow plow blade(s) fully raised so the snow plow blade(s) would normally be in the raised position when the microcontroller 362 is activated. Accordingly, in a preferred embodiment the microcontroller 362 will initialize the value of the index position to the upper limit of the index range.

In one embodiment, the microcontroller 362 is programmed to implement logic that determines that the switch activation electrical signals indicate that the road treatment element is in the engaged configuration when the current index position is below the upper limit of the index range, and determines that the switch activation electrical signals indicate that the road treatment element is in the disengaged configuration when the current index position is at the upper limit of the index range. In this embodiment, the index range is set to approximate the range of motion of a snow plow blade within which the snow plow blade may still be considered to be engaged with the road surface. For example, an operator may need to raise the snow plow blade slightly to accommodate a raised manhole or uneven pavement while still keeping the snow plow blade close enough to the road surface that effective plowing is maintained. Accordingly, the index range would be set based on the number of timing cycles corresponding to movement of the snow plow blade between a lowermost, fully engaged position and a position where it can no longer be considered to be effectively engaged with the road surface (i.e. it is no longer effectively plowing). The magnitude of the index range in this embodiment would thus be much smaller than the number of timing cycles that would be counted as the snow plow blade is moved from the fully raised to the fully lowered position (or raised from the fully lowered position to the fully raised position). As a result, as the operator lowers the snow plow blade from the fully raised position, the index position will be decremented until it reaches the lower limit of the index range (e.g. from 200 to 0) and then will be maintained (or continually reset to) the lower limit of the index range as the operator continues to lower the snow plow blade. As such, when the operator stops lowering the snow plow blade, presumably because the snow plow blade is in the fully lowered position, the current index position will be at the lower limit (e.g. 0 where the index range is 0 to 200). Because the current index position is below the upper limit (e.g. 200) of the index range, the microcontroller 362 determines that the switch activation electrical signals indicate that the road treatment element (e.g. snow plow) is in the engaged configuration. If the operator raises the snow plow blade slightly, but by a small enough amount that the snow plow blade is effectively engaged with the road surface, the current index position will be incremented, but will remain below the upper limit (e.g. 200) of the index range. Accordingly, the microcontroller 362 still determines that the switch activation electrical signals indicate that the road treatment element (e.g. snow plow) is in the engaged configuration. If the operator lowers the snow plow blade again, the current index position will be decremented back toward the lower limit. However, if the operator raises the snow plow blade, either in discrete increments or in a single movement, sufficiently that it can no longer be considered to be effectively engaged with the road surface (i.e. it is no longer effectively plowing), the current position index will be incremented up to the upper limit. The current index value will be maintained at (or continuously reset to) the upper limit (e.g. 200) of the index range as the operator continues to raise the snow plow blade. With the current index value at the upper limit of the index range, the microcontroller 362 determines that the switch activation electrical signals indicate that the road treatment element is in the disengaged configuration. When the operator again lowers the snow plow blade to the fully lowered position, the current index position will be decremented back down to the lower limit (e.g. 0) and, once the current index value is below the upper limit (e.g. 200), the microcontroller 362 again determines that the switch activation electrical signals indicate that the road treatment element (e.g. snow plow) is in the engaged configuration.

Figure 5A:
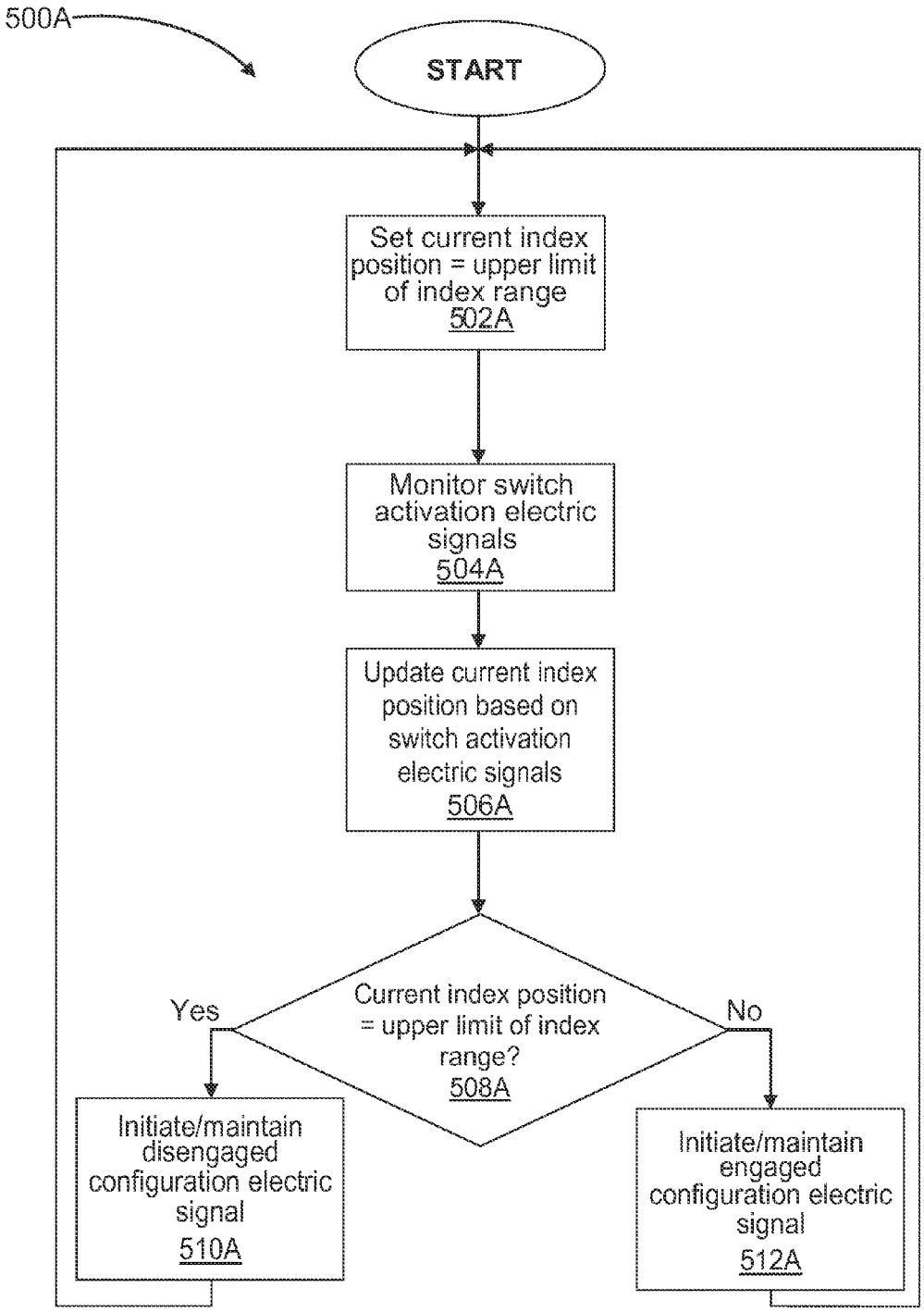
FIG. 5A is a flow chart showing second exemplary logic for a control circuit of a position reporting system.

Reference is now made to FIG. 5A, which is a flow chart 500A illustrating the logic implemented by the microcontroller 362 in the above-described embodiment. The logic shown in the flow chart 500A would be executed as long as the control circuit 344 is receiving power. At step 502A, the microcontroller 362 sets the current index position equal to the upper limit of the index range. For example, if the index range were 0 to 200, the microcontroller 362 would set the current index position to 200. At step 504A, the microcontroller 362 monitors the switch activation electrical signals, and at step 506A, the microcontroller 362 updates the index position based on the switch activation electrical signals by incrementing, decrementing or maintaining the current value of the index position. The current value of the index position would be maintained if neither of the pneumatically activated switches was closed. The current value of the index position would also be maintained if the current value of the index position was at the lower limit of the index range and the switch activation electrical signals indicated the index position should be decremented, or if the current value of the index position was at the upper limit of the index range and the switch activation electrical signals indicated the index position should be incremented. The microcontroller 362 may update the index position each time that a timing cycle is counted during which one of the pneumatically activated switches is closed, or may count the number of timing cycles within a continuous period during which one of the pneumatically activated switches is closed and only update the index position after the respective pneumatically activated switch is opened.

After updating the index position at step 506A, the microcontroller 362 proceeds to step 508A to check whether the current index value is equal to the upper limit of the index range. For example, if the index range were 0 to 200, at step 508A the microcontroller 362 would check whether the current index value were equal to 200. If the current index value is equal to the upper limit of the index range (a "yes" at step 508A), the method proceeds to step 510A to initiate (or maintain if already initiated) the disengaged configuration electric signal. Conversely, if the current index value is not equal to (i.e. is below) the upper limit of the index range (a "no" at step 508A), the method proceeds to step 512A to initiate (or maintain if already initiated) the engaged configuration electric signal. Thus, at steps 508A, 510A and 512A, the microcontroller 362 determines that the switch activation electrical signals indicate that the road treatment element is in the engaged configuration when the current index position is below the upper limit of the index range, and determines that the switch activation electrical signals indicate that the road treatment element is in the disengaged configuration when the current index position is at the upper limit of the index range. After either of steps 510A or 512A, the microcontroller 362 returns to step 504A to continue monitoring the switch activation electrical signals. One skilled in the art will appreciate that at step 508A, the microcontroller 362 may equivalently test whether the current index value is below the upper limit of the index range, with the positions of the "yes" and "no" outputs reversed.

The logic described above and illustrated in FIG. 5A is able to detect relatively fine gradations in the movement of the snow plow blade. However, it relies on relative positioning, and presumes that that the operator of the snow plowing vehicle will not attempt to "defeat" the system by only partially lowering the snow plow blade at the beginning of his or her run or by raising the snow plow blade out of engagement and then lowering it by a significantly lesser amount than it was raised.

In another embodiment, the index range is calibrated to approximate the entire range of motion of the snow plow blade between the fully raised position and the fully lowered position, and a portion of the index range adjacent the lower limit thereof may be designated as an engagement limit region. The engagement limit region would be set to approximate the range of motion of a snow plow blade within which the snow plow blade may still be considered to be engaged with the road surface, for example the lowest decile of the index range (e.g. if the index range is 0 to 255, the engagement limit region might be 0 to 25 or 0 to 26). The exact proportion of the limit range that would be set as the engagement limit region will depend on the particular characteristics of the snow plow system being monitored. In this embodiment, the microcontroller 362 determines that the switch activation electrical signals indicate that the road treatment element is in the engaged configuration when the current index position is within the engagement limit region of the index range, and determines that the switch activation electrical signals indicate that the road treatment element is in the disengaged configuration when the current index position is outside the engagement limit region of the index range. Accordingly, after initializing the index position to the upper limit of the index range, the microcontroller 362 will begin sending the disengaged configuration electric signal, and will only send the engaged configuration electric signal if the snow plow blade has been lowered sufficiently to decrement the index position into the engagement limit region. Similarly, if the snow plow blade were later raised sufficiently to increment the index position above the engagement limit region, the microcontroller 362 will again send the disengaged configuration electric signal, and will only send the engaged configuration electric signal if the snow plow blade is again lowered sufficiently to decrement the index position back into the engagement limit region.

Figure 5B:
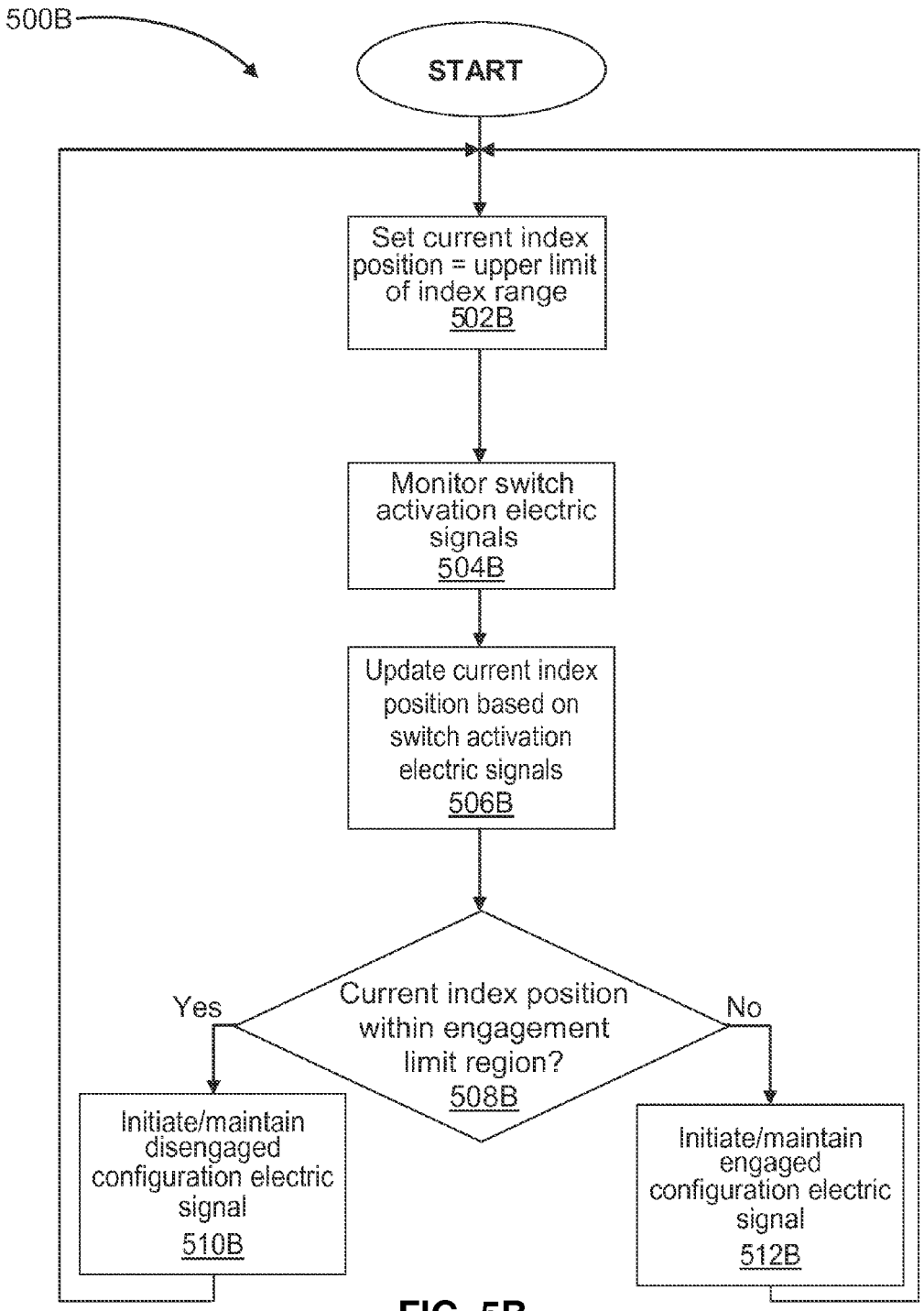
FIG. 5B is a flow chart showing third exemplary logic for a control circuit of a position reporting system.

Reference is now made to FIG. 5B, which is a flow chart 500B illustrating the logic implemented by the microcontroller 362 in the embodiment in which an engagement limit region within the index region is used. The logic shown in the flow chart 500B is similar to the logic shown in the flow chart 500A, with like reference numerals indicating corresponding steps, except with the suffix "B" instead of "A". The logic shown in the flow chart 500B differs from the logic shown in the flow chart 500A in that at step 508B, the microcontroller 362 checks whether the current index position is within the engagement limit region instead of checking whether the current index value is equal to the upper limit of the index range. If the microcontroller 362 determines that the current index position is not within the engagement limit region (a "no" at step 508B), the method proceeds to step 510B to initiate (or maintain if already initiated) the disengaged configuration electric signal. Conversely, if the microcontroller 362 determines that the current index position is not within the engagement limit region (a "yes" at step 508B), the method proceeds to step 512B to initiate (or maintain if already initiated) the engaged configuration electric signal. Thus, at steps 508B, 510BA and 512B, the microcontroller 362 determines that the switch activation electrical signals indicate that the road treatment element is in the engaged configuration when the current index position is within the engagement limit region of the index range, and determines that the switch activation electrical signals indicate that the road treatment element is in the disengaged configuration when the current index position is outside the engagement limit region of the index range. After either of steps 510B or 512B, the microcontroller 362 returns to step 504B to continue monitoring the switch activation electrical signals.

Figure 5C:
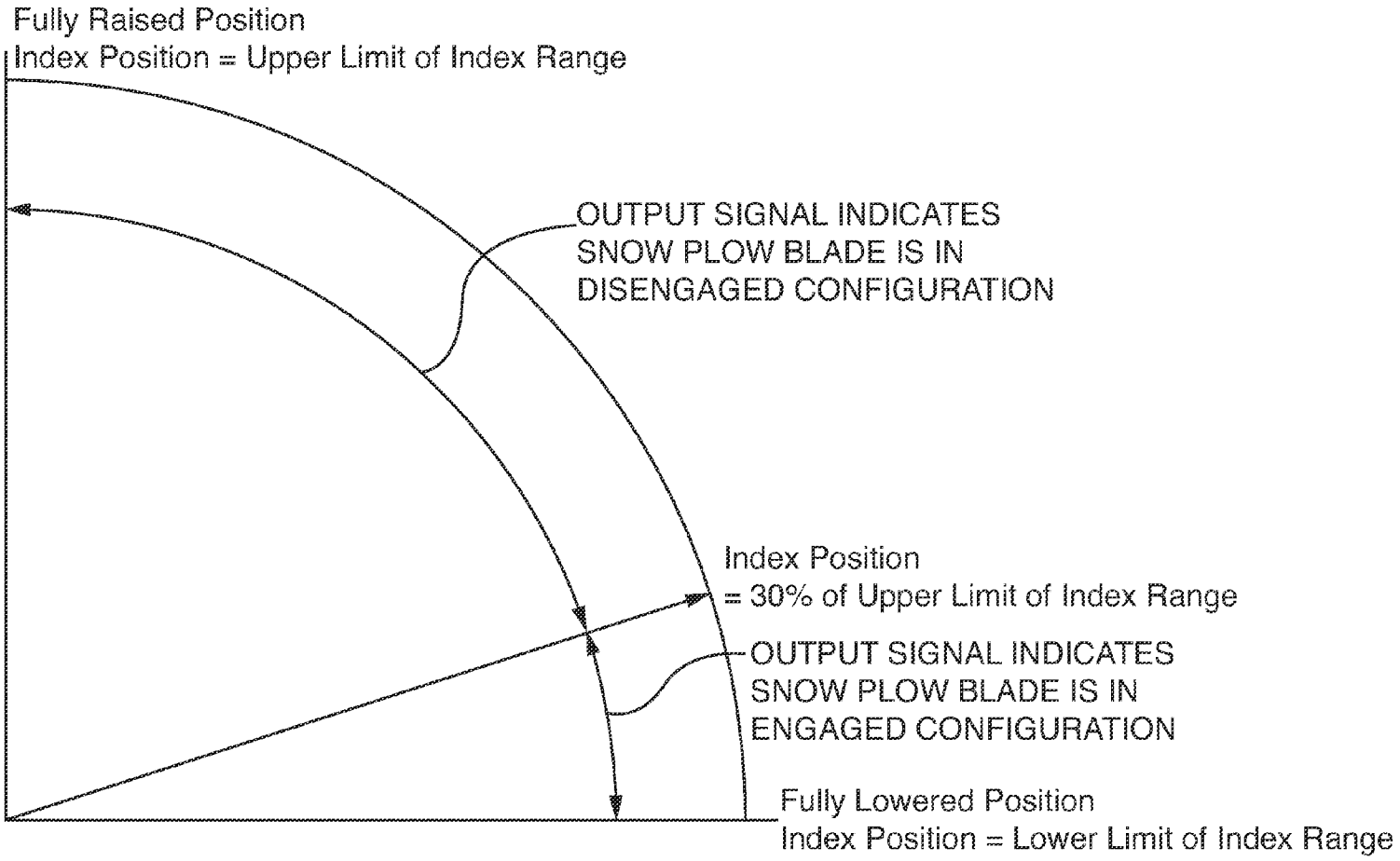
FIG. 5C graphically illustrates the concept of an index range and engagement limit region.

FIG. 5C graphically illustrates the concept of the index range and engagement limit region for an embodiment in which the engagement limit region is the lowermost three deciles (lower 30%) of the index range.

Figure 6:
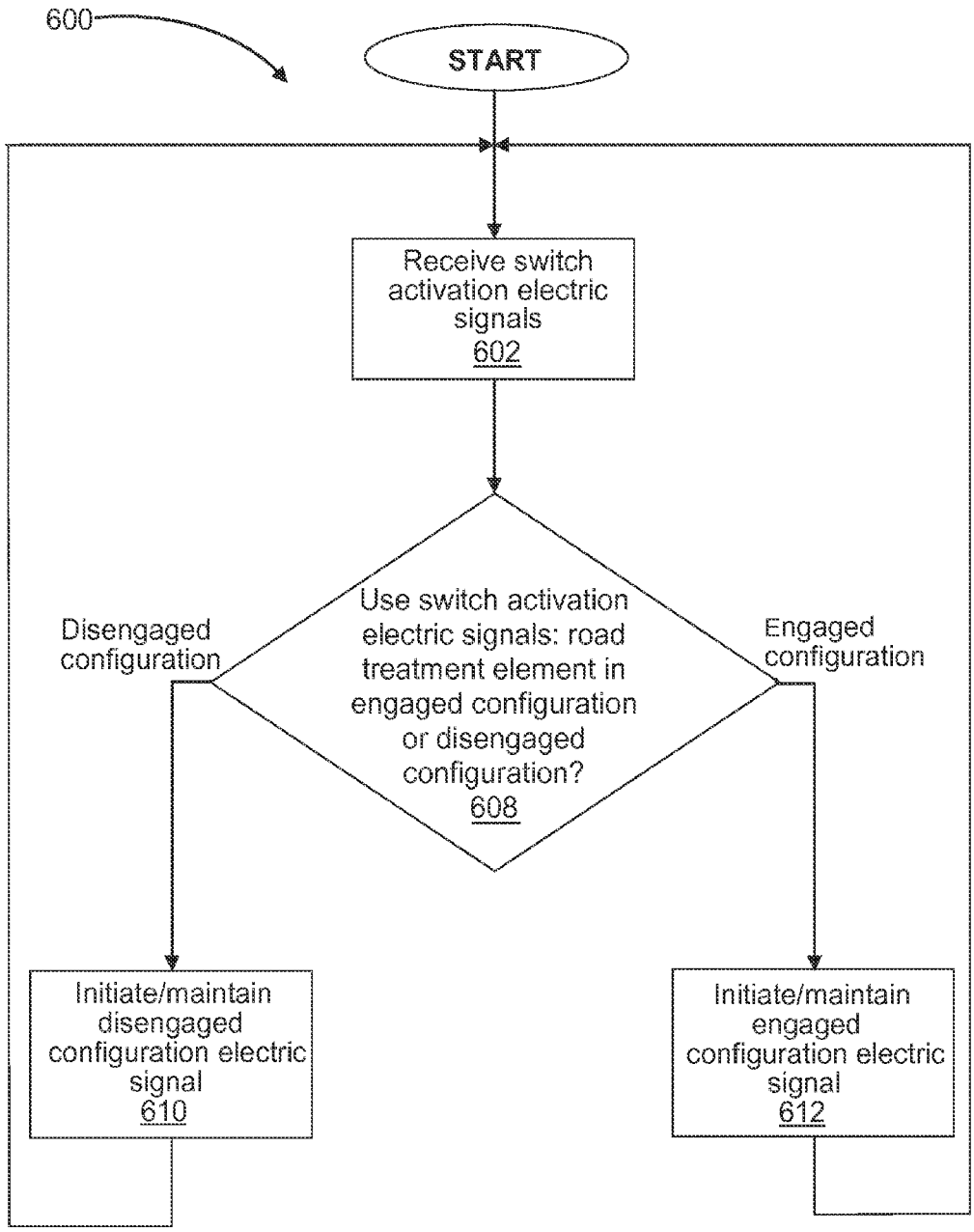
FIG. 6 is a flow chart showing an exemplary method for reporting a position of at least one air-over-hydraulic road treatment element.

The exemplary position reporting system 330 described above represents one particular apparatus for implementing a method for reporting a position of at least one air-over-hydraulic road treatment element. With reference now to FIG. 6, an exemplary method 600 for reporting a position of at least one air-over-hydraulic road treatment element is illustrated more generally in flow chart form; the method 600 is implemented for each pair of pneumatically activated switches. At step 602, the method 600 receives switch activation electrical signals from at least one pair of pneumatically activated switches. As noted above in the context of FIG. 2, each pair of pneumatically activated switches is associated with a respective air-over-hydraulic road treatment element, and within each pair of pneumatically activated switches, each pneumatically activated switch is pneumatically coupled to a respective one of two pilot air sources. One of the one pilot air sources is associated with movement of the road treatment element toward an engaged configuration and the other pilot air source is associated with movement of the road treatment element toward a disengaged configuration.

At step 608, the method 600 uses the switch activation electrical signals to determine whether the road treatment element is in an engaged configuration or a disengaged configuration. Step 608 may be implemented, for example, using one of the exemplary logical procedures described above and illustrated in FIGS. 4, 5A and 5B, or using other suitable logic. Responsive only to the switch activation electrical signals indicating at step 608 that the road treatment element is in the disengaged configuration, the method 600 proceeds to step 610, where the method 600 initiates (or maintains if already initiated) a disengaged configuration electric signal. Conversely, responsive only to the switch activation electrical signals indicating at step 608 that the road treatment element is in the engaged configuration, the method 600 proceeds to step 612, where the method 600 initiates (or maintains if already initiated) an engaged configuration electric signal. After either step 610 or 612, the method 600 returns to step 602. As can be seen from the logic flow of steps 602, 608, 610 and 612, the method 600 maintains the disengaged configuration electric signal until the switch activation electrical signals indicate at step 608 that the road treatment element is in the engaged configuration, and likewise maintains the engaged configuration electric signal until the switch activation electrical signals indicate at step 608 that the road treatment element is in the disengaged configuration. The engaged configuration electric signal and the disengaged configuration electric signal are mutually exclusive.

As noted above, in one exemplary embodiment, the control circuit 344 includes a microcontroller 362 capable of executing programmed instructions. Aspects of the present disclosure can be implemented by special purpose hardware-based systems that perform the specified functions or acts, or combinations of special purpose hardware and computer instructions.

Figure 7:
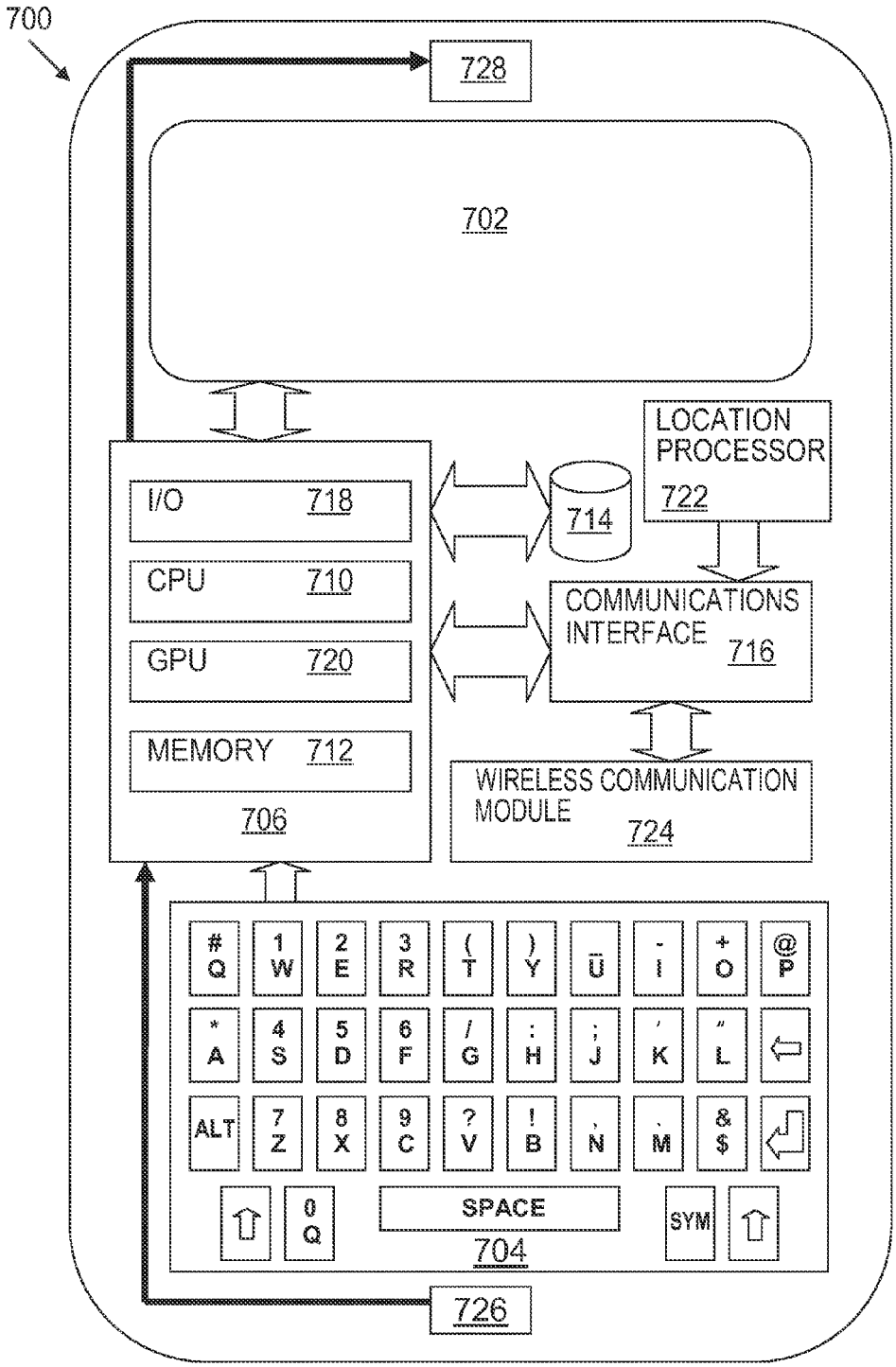
FIG. 7 (PRIOR ART)
FIG. 7 is a functional block diagram of an exemplary networked wireless mobile telecommunication computing device.

It is also contemplated that position reporting systems according to the present disclosure can be integrated with networked mobile wireless telecommunication computing device. FIG. 7 shows an exemplary networked mobile wireless telecommunication computing device in the form of a smartphone 700. The smartphone 700 includes a display 702, an input device in the form of keyboard 704 and an onboard computer system 706. The display 702 may be a touchscreen display and thereby serve as an additional input device, or as an alternative to the keyboard 704. The onboard computer system 706 comprises a central processing unit (CPU) 710 having one or more processors or microprocessors for performing arithmetic calculations and control functions to execute software stored in an internal memory 712, preferably random access memory (RAM) and/or read only memory (ROM) is coupled to additional memory 714 which will typically comprise flash memory, which may be integrated into the smartphone 700 or may comprise a removable flash card, or both. The smartphone 700 also includes a communications interface 716 which allows software and data to be transferred between the smartphone 700 and external systems and networks. The communications interface 716 is coupled to one or more wireless communication modules 724, which will typically comprise a wireless radio for connecting to one or more of a cellular network, a wireless digital network or a Wi-Fi network. The communications interface 716 will also typically enable a wired connection of the smartphone 700 to an external computer system. A microphone 726 and speaker 728 are coupled to the onboard computer system 706 to support the telephone functions managed by the onboard computer system 706, and a location processor 722, including GPS receiver hardware and support for wireless triangulation, is also coupled to the communications interface 716 to support navigation operations by the onboard computer system 706. Input and output to and from the onboard computer system 706 is administered by the input/output (I/O) interface 718, which administers control of the display 702, keyboard 704, microphone 726 and speaker 728. The onboard computer system 706 may also include a separate graphical processing unit (GPU) 720. The various components are coupled to one another either directly or by coupling to suitable buses.

The previously described smartphone 700 of FIG. 7 may be utilized in conjunction with embodiment of the present disclosure. For example, the output terminals of position reporting systems according to the present disclosure can be coupled, via suitable adaptors, to the communications interface 716 of a smartphone 700, or the control circuit may include, or be coupled to, suitable wireless hardware (e.g. WiFi) to enable a wireless connection to the smartphone 700 via a wireless communication module 724 thereof. The smartphone 700 may execute software for recording output signals (i.e. engaged configuration electric signals and disengaged configuration electric signals) received at the communications interface 716 or at a wireless communication module 724 and associating these output signals with a corresponding geolocation using the location processor 722. Thus, the smartphone 700 can, in cooperation with a position reporting system according to the present disclosure, generate a record of whether a particular snow plow blade was in the engaged configuration or the disengaged configuration at a particular geolocation. The smartphone 700 can retain this record and/or transmit it to another computer system (e.g. using a cellular data network). This enables the smartphone 700 to function as a backup for, or as an alternative to, a conventional a GPS/AVL-equipped recording device. It is also contemplated that, by way of a suitable adaptor, pneumatically activated switches coupled to the air signal lines may provide their switch activation electrical signals directly to the smartphone 700, which may execute suitable software for using the switch activation electrical signals to determine whether the road treatment element is in an engaged configuration or a disengaged configuration. Thus, a suitably programmed smartphone (or other general purpose computing device) that receives switch activation electrical signals as described herein may effectively be considered to be a control circuit as that term is used herein. In some instances, a smartphone or other general purpose computing device (e.g., including a suitably programmed processor coupled to memory) may be programmed with specific computer-executable instructions to implement other functionalities described herein. For example, a smartphone or general purpose computing device may be programmed with an application or other computer-executable code that serve to emulate the circuits described herein, or otherwise serve to implement the embodiments described herein, or portions of such embodiments.

Certain currently preferred embodiments have been described by way of example. It will be apparent to persons skilled in the art that a number of variations and modifications can be made without departing from the scope of the claims. The term "exemplary," as used herein, is intended to designate examples within the scope of the present disclosure, and, unless otherwise stated, is not intended to indicate that these examples are preferable to other possible implementations or embodiments of the present disclosure.

Conditional language such as, among others, "can," "could," "might" or "may," unless specifically stated otherwise, are otherwise understood within the context as used in general to present that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Unless otherwise explicitly stated, articles such as 'a' or 'an' should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

What is claimed is:

1. A method for reporting a position of at least one air-over-hydraulic road treatment element, the method comprising:

receiving first and second switch activation electrical signals from at least one pair of pneumatically activated switches, wherein:

each pair of pneumatically activated switches is associated with a respective air-over-hydraulic road treatment element;

within each pair of pneumatically activated switches:

a first one of the pneumatically activated switches is pneumatically coupled to a first pilot air source associated with movement of the air-over-hydraulic road treatment element toward an engaged configuration so as to generate a first switch activation electrical signal indicating movement of the air-over-hydraulic road treatment element toward the engaged configuration when air is received from the first pilot air source; and a second one of the pneumatically activated switches is pneumatically coupled to a second pilot air source associated with movement of the air-over-hydraulic road treatment element toward a disengaged configuration so as to generate a second switch activation electrical signal indicating movement of the air-over-hydraulic road treatment element toward the disengaged configuration when air is received from the second pilot air source;

for each pair of pneumatically activated switches:

using the switch activation electrical signals to determine whether the air-over-hydraulic road treatment element is in an engaged configuration or a disengaged configuration;

responsive only to the switch activation electrical signals indicating that the air-over-hydraulic road treatment element is in the engaged configuration:

initiating an engaged configuration electric signal; and maintaining the engaged configuration electric signal until the switch activation electrical signals indicate that the air-over-hydraulic road treatment element is in the disengaged configuration;

responsive only to the switch activation electrical signals indicating that the air-over-hydraulic road treatment element is in the disengaged configuration:

initiating a disengaged configuration electric signal; and maintaining the disengaged configuration electric signal until the switch activation electrical signals indicate that the air-over-hydraulic road treatment element is in the engaged configuration;

wherein the engaged configuration electric signal and the disengaged configuration electric signal are mutually exclusive.

2. The method of claim 1, wherein for each pair of pneumatically activated switches, the engaged configuration electric signal and the disengaged configuration electric signal each consist of electrical signals applied to two output terminals.

3. The method of claim 2, wherein, for each pair of pneumatically activated switches:

the engaged configuration electric signal comprises applying a voltage only to one of the output terminals; and the disengaged configuration electric signal comprises applying a voltage only to the other of the output terminals.

4. The method of claim 2, wherein, for each pair of pneumatically activated switches:

the engaged configuration electric signal comprises grounding only one of the output terminals; and the disengaged configuration electric signal comprises grounding only the other of the output terminals.

5. The method of claim 1, wherein using the switch activation electrical signals to determine whether the air-over-hydraulic road treatment element is in an engaged configuration or a disengaged configuration comprises, for each pair of pneumatically activated switches:

using the switch activation electrical signals to determine a current index position for that pair of pneumatically activated switches; and using the current index position to determine whether the switch activation electrical signals indicate that the air-over-hydraulic road treatment element is in the engaged configuration or the disengaged configuration.

6. The method of claim 5, wherein, for each pair of pneumatically activated switches, using the switch activation electrical signals to determine a current index position for that pair of pneumatically activated switches comprises:

for one pneumatically activated switch in that pair of pneumatically activated switches, incrementing the current index position according to a number of timing cycles during which the one pneumatically activated switch is closed; and for the other pneumatically activated switch in that pair of pneumatically activated switches, decrementing the current index position according to a number of timing cycles during which the other pneumatically activated switch is closed.

7. The method of claim 6, wherein timing cycles are executed at different rates for each pneumatically activated switch in each pair of pneumatically activated switches.

8. The method of claim 6, wherein, for each pair of pneumatically activated switches, using the current index position to determine whether the switch activation electrical signals indicate that the air-over-hydraulic road treatment element is in the engaged configuration or the disengaged configuration comprises:

determining that the switch activation electrical signals indicate that the air-over-hydraulic road treatment element is in the engaged configuration when the current index position is within an engagement limit region of an index range; and determining that the switch activation electrical signals indicate that the air-over-hydraulic road treatment element is in the disengaged configuration when the current index position is outside the engagement limit region of the index range.

9. The method of claim 6, wherein, for each pair of pneumatically activated switches, using the current index position to determine whether the switch activation electrical signals indicate that the air-over-hydraulic road treatment element is in the engaged configuration or the disengaged configuration comprises:

determining that the switch activation electrical signals indicate that the air-over-hydraulic road treatment element is in the engaged configuration when the current index position is below an upper limit of an index range; and determining that the switch activation electrical signals indicate that the air-over-hydraulic road treatment element is in the disengaged configuration when the current index position is at the upper limit of the index range.

10. The method of claim 1, wherein, for each pair of pneumatically activated switches:

the switch activation electrical signals indicate that the air-over-hydraulic road treatment element is in the engaged configuration when the first switch activation electrical signal satisfies a first predetermined position change threshold; and the switch activation electrical signals indicate that the air-over-hydraulic road treatment element is in the disengaged configuration when the second switch activation electrical signal satisfies a second predetermined position change threshold.

11. The method of claim 10, wherein:

the first predetermined position change threshold is satisfied by the first switch activation electrical signal persisting for a first predetermined continuous duration; and the second predetermined position change threshold is satisfied by the second switch activation electrical signal persisting for a second predetermined continuous duration.

12. The method of claim 10, wherein:

the first predetermined position change threshold is satisfied by a first predetermined cumulative duration of a consecutive sequence of discrete instances of the first switch activation electrical signal; and the second predetermined position change threshold is satisfied by a second predetermined cumulative duration of a consecutive sequence of discrete instances of the second switch activation electrical signal.

13. The method of claim 10, wherein:

the first predetermined position change threshold is satisfied by a predetermined number of consecutive discrete instances of the first switch activation electrical signal; and the second predetermined position change threshold is satisfied by a predetermined number of consecutive discrete instances of the second switch activation electrical signal.

14. The method of claim 10, wherein:

the first predetermined position change threshold is satisfied by any one of:

the first switch activation electrical signal persisting for a first predetermined continuous duration;

a first predetermined cumulative duration of a consecutive sequence of discrete instances of the first switch activation electrical signal; or by a predetermined number of consecutive discrete instances of the first switch activation electrical signal; and the second predetermined position change threshold is satisfied by any one of:

the second switch activation electrical signal persisting for a second predetermined continuous duration;

a second predetermined cumulative duration of a consecutive sequence of discrete instances of the second switch activation electrical signal; or by a predetermined number of consecutive discrete instances of the second switch activation electrical signal.

15. The method of claim 1, wherein the air-over-hydraulic road treatment element is a snow plow blade.

16. A system for reporting a position of at least one air-over-hydraulic road treatment element comprises:

at least one pair of pneumatically activated switches; and a control circuit connectible in electrical communication with a power source;

wherein, for each pair of pneumatically activated switches:

each pneumatically activated switch is electrically coupled to the control circuit to provide a switch activation electrical signal to the control circuit when a flow of pilot air activates the pneumatically activated switch;

a first one of the pneumatically activated switches is pneumatically coupled to a first pilot air input associated with movement of the air-over-hydraulic road treatment element toward an engaged configuration so as to generate a first switch activation electrical signal indicating movement of the air-over-hydraulic road treatment element toward the engaged configuration; and a second one of the pneumatically activated switches is pneumatically coupled to a second pilot air input associated with movement of the air-over-hydraulic road treatment element toward a disengaged configuration so as to generate a second switch activation electrical signal indicating movement of the air-over-hydraulic road treatment element toward the disengaged configuration;

the control circuit configured to, for each pair of pneumatically activated switches:

use the switch activation electrical signals to determine whether the air-over-hydraulic road treatment element is in an engaged configuration or a disengaged configuration;

responsive only to the switch activation electrical signals indicating that the air-over-hydraulic road treatment element is in the engaged configuration:

initiate an engaged configuration electric signal; and maintain the engaged configuration electric signal until the switch activation electrical signals indicate that the air-over-hydraulic road treatment element is in the disengaged configuration;

responsive only to the switch activation electrical signals indicating that the air-over-hydraulic road treatment element is in the disengaged configuration:

initiate a disengaged configuration electric signal; and maintain the disengaged configuration electric signal until the switch activation electrical signals indicate that the air-over-hydraulic road treatment element is in the engaged configuration;

wherein the control circuit is configured so that, for each pair of pneumatically activated switches, the engaged configuration electric signal and the disengaged configuration electric signal are mutually exclusive.

17. The system of claim 16, wherein the control circuit has two output terminals for each pair of pneumatically activated switches.

18. The system of claim 17, wherein, for each pair of pneumatically activated switches:

the engaged configuration electric signal comprises applying a voltage only to one of the output terminals; and the disengaged configuration electric signal comprises applying a voltage only to the other of the output terminals.

19. The system of claim 17, wherein, for each pair of pneumatically activated switches:

the engaged configuration electric signal comprises grounding only one of the output terminals; and the disengaged configuration electric signal comprises grounding only the other of the output terminals.

20. The system of claim 16, wherein:

the control circuit includes at least one microcontroller;

each pneumatically activated switch is electrically coupled to the at least one microcontroller;

the at least one microcontroller is configured to, for each pair of pneumatically activated switches:

use the switch activation electrical signals to determine a current index position for that pair of pneumatically activated switches; and use the current index position to determine whether the switch activation electrical signals indicate that the air-over-hydraulic road treatment element is in the engaged configuration or the disengaged configuration.

21. The system of claim 20, wherein the at least one microcontroller is configured to, for each pair of pneumatically activated switches, use the switch activation electrical signals to determine a current index position for that pair of pneumatically activated switches by:

for one pneumatically activated switch in that pair of pneumatically activated switches, incrementing the current index position according to a number of timing cycles during which the one pneumatically activated switch is closed; and for the other pneumatically activated switch in that pair of pneumatically activated switches, decrementing the current index position according to a number of timing cycles during which the other pneumatically activated switch is closed.

22. The system of claim 21, wherein the control circuit is configured so that the at least one microcontroller can selectively execute timing cycles at different rates for each pneumatically activated switch in each pair of pneumatically activated switches.

23. The system of claim 21, wherein the at least one microcontroller is configured to, for each pair of pneumatically activated switches, use the current index position to determine whether the switch activation electrical signals indicate that the air-over-hydraulic road treatment element is in the engaged configuration or the disengaged configuration by:

determining that the switch activation electrical signals indicate that the air-over-hydraulic road treatment element is in the engaged configuration when the current index position is within an engagement limit region of an index range; and determining that the switch activation electrical signals indicate that the air-over-hydraulic road treatment element is in the disengaged configuration when the current index position is outside the engagement limit region of the index range.

24. The system of claim 21, wherein the at least one microcontroller is configured to, for each pair of pneumatically activated switches, use the current index position to determine whether the switch activation electrical signals indicate that the road treatment element is in the engaged configuration or the disengaged configuration by:

determining that the switch activation electrical signals indicate that the road treatment element is in the engaged configuration when the current index position is below an upper limit of an index range; and determining that the switch activation electrical signals indicate that the road treatment element is in the disengaged configuration when the current index position is at the upper limit of the index range.

25. The system of claim 16, wherein the control circuit is configured so that:

the switch activation electrical signals indicate that the road treatment element is in the engaged configuration when the first switch activation electrical signal satisfies a first predetermined position change threshold; and the switch activation electrical signals indicate that the road treatment element is in the disengaged configuration when the second switch activation electrical signal satisfies a second predetermined position change threshold.

26. The system of claim 25, wherein the control circuit is configured so that:

the first predetermined position change threshold is satisfied by the first switch activation electrical signal persisting for a first predetermined continuous duration; and the second predetermined position change threshold is satisfied by the second switch activation electrical signal persisting for a second predetermined continuous duration.

27. The system of claim 25, wherein the control circuit is configured so that:

the first predetermined position change threshold is satisfied by a first predetermined cumulative duration of a consecutive sequence of discrete instances of the first switch activation electrical signal; and the second predetermined position change threshold is satisfied by a second predetermined cumulative duration of a consecutive sequence of discrete instances of the second switch activation electrical signal.

28. The system of claim 25, wherein the control circuit is configured so that:

the first predetermined position change threshold is satisfied by a predetermined number of consecutive discrete instances of the first switch activation electrical signal; and the second predetermined position change threshold is satisfied by a predetermined number of consecutive discrete instances of the second switch activation electrical signal.

29. The system of claim 25, wherein the control circuit is configured so that:

the first predetermined position change threshold is satisfied by any one of:

the first switch activation electrical signal persisting for a first predetermined continuous duration;

a first predetermined cumulative duration of a consecutive sequence of discrete instances of the first switch activation electrical signal; or by a predetermined number of consecutive discrete instances of the first switch activation electrical signal; and the second predetermined position change threshold is satisfied by any one of:

the second switch activation electrical signal persisting for a second predetermined continuous duration;

a second predetermined cumulative duration of a consecutive sequence of discrete instances of the second switch activation electrical signal; or by a predetermined number of consecutive discrete instances of the second switch activation electrical signal.

30. The system of claim 15, wherein the system comprises at least two pairs of pneumatically activated switches.

* * * * *